US007152260B2

(12) United States Patent
Ota

(10) Patent No.: US 7,152,260 B2
(45) Date of Patent: Dec. 26, 2006

(54) HOLDING MEANS FOR USE IN BLANKET OR COVERLET AND THE LIKE

(75) Inventor: Kinjiro Ota, Tokyo (JP)

(73) Assignee: OTA Kosan Corporation, Tokyo (JP)

( * ) Notice: Subject to any disclaimer, the term of this patent is extended or adjusted under 35 U.S.C. 154(b) by 215 days.

(21) Appl. No.: 10/928,336

(22) Filed: Aug. 27, 2004

(65) Prior Publication Data

US 2006/0000061 A1 Jan. 5, 2006

(30) Foreign Application Priority Data

Jun. 30, 2004 (JP) ..... 2004-194961
Jul. 14, 2004 (JP) ..... 2004-207685

(51) Int. Cl.
*A47C 21/02* (2006.01)

(52) U.S. Cl. ..... 5/504.1; 5/498; 5/658; 24/72.5

(58) Field of Classification Search ..... None
See application file for complete search history.

(56) References Cited

U.S. PATENT DOCUMENTS

| | | | | | |
|---|---|---|---|---|---|
| 420,083 | A | * | 1/1890 | McArthur | 24/301 |
| 443,742 | A | * | 12/1890 | Birdsall | 24/301 |
| 557,456 | A | * | 3/1896 | Utter | 24/467 |
| 829,118 | A | * | 8/1906 | Meek | 24/504 |
| 852,180 | A | * | 4/1907 | Hoffman | 24/72.5 |
| 1,195,874 | A | * | 8/1916 | Thurston | 24/507 |
| 1,365,169 | A | * | 1/1921 | Goldberg | 24/538 |
| 1,438,475 | A | * | 12/1922 | Bisbing | 5/498 |
| 1,602,305 | A | * | 10/1926 | Helm | 5/498 |
| 1,950,084 | A | * | 3/1934 | Halsey | 24/72.5 |

(Continued)

FOREIGN PATENT DOCUMENTS

EP 450964 A1 * 10/1991

(Continued)

*Primary Examiner*—Robert G. Santos
(74) *Attorney, Agent, or Firm*—Dann, Dorfman, Herrell and Skillman, P.C.

(57) ABSTRACT

A holding appliance for use in bedding, includes a belt adapted to be wound around a bottom surface of a bed, two hook devices provided at both terminals of the belt, and two fastening devices for holding and fastening portions of a periphery of the bedding, the fastening devices being adapted to be caught by the hook devices. In accordance with an embodiment of this invention, there is disclosed a holding appliance for use in bedding, that includes a hook member adapted to be interposed and located between a bed base and a mattress on the bed base, and a fastening device for holding and fastening a portion of a periphery of the bedding, the fastening device being adapted to be caught by the hooking member. In accordance with another embodiment of this invention, there is disclosed a holding appliance for use in bedding, that includes a body adapted to be interposed and located between a bed base and a mattress on the bed base, and a fastening device pivotally supported to the body for holding and fastening a portion of a periphery of the bedding. Each of the fastening devices includes a substantially ring-like body having a pair of first spaced apart portions having first ends and second ends, a second portion disposed between the first ends of the first spaced apart portions and interconnecting the first spaced apart portions, and a third portion disposed between the second ends of the first spaced apart portions and interconnecting the first spaced apart portions, and a holding member bridged between the first spaced apart portions so as to be slidable along the first spaced apart portions.

40 Claims, 16 Drawing Sheets

U.S. PATENT DOCUMENTS

| | | | | | |
|---|---|---|---|---|---|
| 2,024,050 | A | * | 12/1935 | May | 24/72.5 |
| 2,155,690 | A | * | 4/1939 | Simpson | 5/498 |
| 2,223,412 | A | * | 12/1940 | Gartz | 24/72.5 |
| 2,284,778 | A | * | 6/1942 | Treiber | 5/498 |
| 2,321,394 | A | * | 6/1943 | King | 24/72.5 |
| 2,326,399 | A | * | 8/1943 | Shileds | 24/72.5 |
| 2,459,497 | A | * | 1/1949 | Calabro | 24/72.5 |
| 2,772,460 | A | * | 12/1956 | Berkowicz et al. | 24/72.5 |
| 2,791,784 | A | * | 5/1957 | Tomsic | 5/496 |
| 2,857,643 | A | * | 10/1958 | Tomsic | 24/72.5 |
| 2,930,053 | A | * | 3/1960 | Nowels | 5/498 |
| 2,931,084 | A | * | 4/1960 | De Witt | 24/72.5 |
| 2,979,737 | A | * | 4/1961 | Pierre | 5/498 |
| 3,011,182 | A | * | 12/1961 | Burks | 5/484 |
| 3,092,848 | A | * | 6/1963 | Gronvold | 5/495 |
| 4,199,830 | A | * | 4/1980 | Ogata | 5/411 |
| 4,276,667 | A | * | 7/1981 | Osbourne | 5/498 |
| 4,521,970 | A | * | 6/1985 | Jester | 33/662 |
| 4,541,137 | A | * | 9/1985 | Murray | 5/498 |
| 4,660,240 | A | * | 4/1987 | Hutton et al. | 5/669 |
| 4,662,016 | A | * | 5/1987 | Seeman | 5/658 |
| 4,698,880 | A | * | 10/1987 | Hamm | 24/72.5 |
| 4,782,543 | A | * | 11/1988 | Hutton et al. | 5/658 |
| 4,825,489 | A | * | 5/1989 | Ross | 5/497 |
| 4,829,617 | A | * | 5/1989 | Dameron | 5/658 |
| 4,862,541 | A | * | 9/1989 | Hutton et al. | 5/496 |
| 4,891,856 | A | * | 1/1990 | Thornhill | 5/496 |
| 4,937,904 | A | * | 7/1990 | Ross | 5/497 |
| 5,014,399 | A | * | 5/1991 | Grisel | 24/72.5 |
| 5,072,470 | A | * | 12/1991 | Lysiak | 5/496 |
| 5,099,531 | A | * | 3/1992 | Schmier | 5/692 |
| 5,148,560 | A | * | 9/1992 | Torres | 5/496 |
| 5,179,743 | A | * | 1/1993 | Lanman | 5/498 |
| 5,325,554 | A | * | 7/1994 | Lewis | 5/498 |
| 5,377,391 | A | * | 1/1995 | Foster | 24/72.5 |
| 5,404,602 | A | * | 4/1995 | Kondo | 5/504.1 |
| 5,467,491 | A | * | 11/1995 | Griffith | 5/658 |
| 5,651,153 | A | * | 7/1997 | Goodrich | 5/498 |
| 5,815,861 | A | * | 10/1998 | LaGrange et al. | 5/504.1 |
| 6,161,235 | A | * | 12/2000 | Smith et al. | 5/504.1 |
| 6,185,766 | B1 | * | 2/2001 | Farrugia | 5/498 |
| 6,295,670 | B1 | * | 10/2001 | Schieberl | 5/504.1 |
| 6,557,194 | B1 | * | 5/2003 | Jeffries et al. | 5/504.1 |
| 6,704,955 | B1 | * | 3/2004 | Jeffries et al. | 5/504.1 |
| 6,836,913 | B1 | * | 1/2005 | Perrin et al. | 5/498 |
| 6,877,175 | B1 | * | 4/2005 | Jeffries et al. | 5/504.1 |
| 2002/0062522 | A1 | * | 5/2002 | Deckert | 5/504.1 |
| 2003/0229973 | A1 | * | 12/2003 | Perrin et al. | 24/72.5 |
| 2006/0000061 | A1 | * | 1/2006 | Ota | 24/72.5 |

FOREIGN PATENT DOCUMENTS

| | | | | |
|---|---|---|---|---|
| FR | 2606986 | A1 | * | 5/1988 |
| GB | 558402 | | * | 1/1944 |
| GB | 716694 | | * | 10/1954 |
| GB | 733980 | | * | 7/1955 |
| GB | 2070424 | A | * | 9/1981 |
| GB | 2163046 | A | * | 2/1986 |
| GB | 2270256 | A | * | 3/1994 |
| JP | 10337233 | | | 12/1998 |
| JP | 2001321255 | | | 11/2001 |

* cited by examiner

HOLDING MEANS FOR USE IN BLANKET OR COVERLET AND THE LIKE

BACKGROUND OF THE INVENTION

1. Field of the Invention

This invention relates to holding means for holding a blanket, coverlet, comfort or the like (hereinafter referred to as "bedding") and preventing the bedding from being shifted or slipping and falling down from a bed.

2. Description of the Related Art

Hitherto, there were employed various types of holding appliances for holding a blanket and preventing it from being shifted or slipping. For example, Japanese Patent Application Laid-Open No. Hei. 10-337233 and No. 2001-321255 each disclose a holding appliance for holding a blanket. The holding appliance comprises a flat belt having first and second belt sections, an adjusting device attached to one end portions of the first and second belt sections for adjusting the whole length of the flat belt, and holding members for holding portions of a periphery of a blanket. The holding members comprise alligator clips provided at the other end portions of the first and second belt sections, or hook-and-loop fasteners. At the time of use of the holding appliance, the flat belt is adapted to be interposed between a bed and a mattress on the bed so as to extend in a crosswise direction of the bed, with the other end portions of the first and second belt sections being drawn out of a space between the bed and the mattress.

In the conventional holding appliance employing the hook-and-loop fasteners as the holding members, ones of hook portions and loop portions of the hook-and-loop fasteners are attached to the other end portions of the first and second belt sections, and the others of the hook portions and loop portions of the hook-and-loop fasteners are attached to the portions of the periphery of the blanket. The hook portions and the loop portions are joined to each other at the time of the use of the holding appliance, whereby the blanket is held by the belt so as not to be shifted or slip. However, in this holding appliance, the others of the hook portions and loop portions of the hook-and-loop fasteners must be attached to the portions of the periphery of the blanket as described above. The attaching of the others of the hook portions and loop portions to the portions of the blanket will limit sewing of the blanket. In addition, when the blanket with the others of the hook portions and loop portions is cleaned several times, capacities of the others of the hook portions and loop portions for bonding with the ones of the hook portions and loop portions that are attached to the belt will be decreased.

In the holding appliance employing the alligator clips as the holding members, the portions of the periphery of the blanket are held by the alligator clips at the time of the use of the holding appliance, whereby the blanket is held by the belt so as to be prevented from being shifted or slipping. However, when any pulling force is applied to the blanket during the use of the holding appliance, for example, when a person who is sleeping utilizing the blanket held by the holding appliance turns over to thereby pull the blanket, the blanket will be easily separated from the alligator clips, since the alligator clips can not exhibit holding force enough to still hold the blanket when the pulling force is applied to the blanket.

The belt-length-adjusting device comprises a substantially rectangular-shaped frame, and a pin bridged between opposite portions of the frame. The adjusting device is attached to the first and second belt sections by causing the one end portion of the first belt section to be coupled to the pin, causing the one end portion of the second belt section to be received through the frame so as to be stridden over the pin, and causing the one end portion of the second belt section to be drawn out of the frame. The adjusting of the whole length of the belt is adapted to be carried out by controlling drawing amount of the one end portion of the second belt section from the frame.

The adjusting of the whole length of the belt is generally performed after holding the portions of the blanket through the holding members. In the conventional holding appliance, the position of the adjusting device attached to the belt is remote from the positions of the alligator clips provided at the belt or the positions of the ones (of the hook portions and loop portions) provided at the belt, so that whenever the adjusting of the whole length of the belt is to be carried after the holding of the portions of the blanket by the holding members, it is necessary to move the belt in order to facilitate the adjusting of the length of the belt. This is very troublesome and will take a lot of labor. Particularly, when the holding appliances are employed in a hospital or a home for the aged, which has many beds, the adjusting of the whole length of the belts of the holding appliances, and re-holding of the blankets by the holding appliances are very troublesome and will take a lot of labor, so that the conventional holding appliances are impractical.

SUMMARY OF THE INVENTION

The present invention has been made with a view to overcoming the foregoing problems of the conventional holding appliances.

It is an object of this invention to provide holding means for holding bedding, which is capable of exhibiting holding force enough to still securely hold the bedding in use, even when any pulling force is applied to the bedding.

It is another object of the present invention to provide holding means for holding bedding, in which the bedding can be easily held.

It is still another object of the present invention to provide holding means for holding bedding, which is practical.

In accordance with an aspect of the present invention, there is provided holding means for holding and fastening bedding. The holding means comprises a belt having both end sections, and a middle section between the both end sections, the belt being adapted to be applied to a bed with the middle section being located below a bottom surface of the bed and with the both end sections being wound around both side corners of the bottom surface of the bed, two hook means provided at terminals of the both end sections of the belt, and two fastening devices for holding and fastening portions of a periphery of the bedding, the fastening devices being adapted to be caught by the two hook means. Each of the two fastening devices comprises a substantially ring-like body and a holding member. The substantially ring-like body comprises a pair of first spaced apart portions having first ends and second ends, a second portion disposed between the first ends of the first spaced apart portions and interconnecting the first spaced apart portions, and a third portion disposed between the second ends of the first spaced apart portions and interconnecting the first spaced apart portions. The holding member is bridged between the first spaced apart portions so as to be slidable along the first spaced apart portions. The bedding is fastened and held by causing one of the portions of the bedding to be inserted through a first space between the second portion of a fastening device and the holding member in a condition where the second portion of the fastening device is located in an upper position, causing the one of the portions of the bedding to be stridden over the holding member, causing the one of the portions of the bedding to be inserted through a second space between the holding member and the third portion of the fastening device, causing the holding member to be slid toward the third portion of the fastening device along the first spaced apart portions of the fastening device, to thereby clamp the one of the portions of the bedding by the holding member and the third portion of the fastening device, causing the fastening device to be turn in such a manner that the second portion of the fastening device is located in a lower position, to thereby cause the one of the portions of the bedding to be wound around the third portion of the fastening device, and causing the second portion of the fastening device to be caught by corresponding one of the two hook means.

A space between the first spaced apart portions of the fastening device may be designed so as to gradually become wide toward the third portion of the fastening device.

The second portion of the fastening device is provided with a recessed region that is adapted to be tightly engaged with the corresponding hook means, whereby the fastening device can be positioned with respect to the corresponding hook means without moving.

The holding member and the third portion of the fastening device may be angular. The belt may have a length enough to allow a person in bed to comfortably sleep without being oppressed by the holding means.

The holding means may further include two adjusting means provided at the terminals of the both end sections of the belt for adjusting a length of the belt. The two hook means are provided at the two adjusting means.

Each of the two adjusting means may comprise a hollow body of a substantially rectangular parallelepiped-shape opened at upper and lower portions thereof, and a substantially C-shaped support member. The hollow body comprises a pair of first spaced apart plate sections which are to face general surfaces of the belt, a pair of second spaced apart plate sections interconnecting the first spaced apart plate sections, and a substantially cylindrical section extending along an upper edge of one of the first spaced apart plate sections, the substantially cylindrical section having a slot circumferentially extending. The substantially C-shaped support member is pivotally supported to the substantially cylindrical section by causing both ends of the substantially C-shaped support member to be engaged with both ends of the substantially cylindrical section. The corresponding one of the two hook means is pivotally supported to the substantially cylindrical section by causing the corresponding hook means to be engaged in the slot. Corresponding one of the terminals of the belt is received in the hollow body through the lower opened portion of the hollow body, wound around the substantially C-shaped support member so as to be folded back, and drawn out of the lower opened portion of the hollow body.

Each of the two adjusting means may comprise a hollow body of a substantially rectangular parallelepiped-shape opened at upper and lower portions thereof, and a support pin. The hollow body comprises a pair of first spaced apart plate sections which are to face general surfaces of the belt, a pair of second spaced apart plate sections interconnecting the first spaced apart plate sections, and bracket plates extending upwardly from upper edges of the second spaced apart sections. The support pin is disposed between the bracket plates and supported to the bracket plates. The corresponding one of the two hook means obliquely extends upwardly from an upper edge of one of the first spaced apart plate sections so as to cross the support pin. Corresponding one of the terminals of the belt is received in the hollow body through the lower opened portion of the hollow body, wound around the support pin so as to be folded back, and drawn out of the lower opened portion of the hollow body.

In accordance with an embodiment of the present invention, there is provided holding means for use in bedding. The holding means comprises a hook means adapted to be interposed and located between a bed base and a mattress on the bed base, the hook means having a hooking section, and a fastening means for holding and fastening a portion of a periphery of the bedding, the fastening means being adapted to be caught by the hooking section of the hook means.

The hook means may comprise a strip-like body. The hooking section is provided at one end of the strip-like body. The strip-like body may be made of material having a high frictional resistance coefficient.

The hook means may comprise a strip-like core, and a coating layer coating at least one general surface of the strip-like body and made of material having a high frictional resistance coefficient. The hooking section is provided at one end of the strip-like core.

The hook means comprises a strip-like core, and a twice-folded coating layer made of material having a high resistance coefficient, the strip-like core being sandwiched between the twice-folded coating layer and bonded to the coating layer.

In accordance with another embodiment of the present invention, there is provided a holding means for use in bedding. The holding means comprises a body adapted to be interposed and located between a bed base and a mattress on the bed base, and a fastening means pivotally supported to the body for holding and fastening a portion of a periphery of the bedding.

The body of the holding means may be shaped like a strip. The fastening means is pivotally supported to one end of the strip-like body. The strip-like body may be made of material having a high frictional resistance coefficient.

The body of the holding means may comprise a strip-like core, and a coating layer coating at least one general surface of the strip-like core, the coating layer being made of material having a high frictional resistance coefficient.

The body of the holding means may comprise a strip-like core, and an endless belt-like coating layer, the strip-like core being disposed in the endless belt-like coating layer and bonded to the coating layer, and the coating layer being made of material having a high frictional resistance coefficient.

In accordance with another aspect of the present invention, there is provided a belt with at least one adjusting means for adjusting a length of the belt. The at least one adjusting means comprises a hollow body of a substantially rectangular parallelepiped-shape opened at upper and lower ends thereof, the hollow body comprising a pair of first spaced apart plate sections which are to face general surfaces of the belt, and a pair of second spaced apart plate sections interconnecting the first spaced apart plate sections, a support member provided at the hollow body so as to be disposed above the upper opened portion of the hollow body, and a hook member provided at the hollow body. An end portion of the belt is received in the hollow body through the lower opened end of the hollow body, wound around the support member so as to be folded back, and drawn out of the lower opened end of the hollow body.

The support member may be formed into a substantially C-shape. One of the first spaced apart plate sections may be provided with a substantially cylindrical section extending along an upper edge thereof. The substantially cylindrical section has a slot circumferentially extending. The substantially C-shaped support member is pivotally supported to the substantially cylindrical section by causing both ends of the substantially C-shaped support member to be engaged with both ends of the substantially cylindrical section. The hook member is pivotally supported to the substantially cylindrical section by causing the hook member to be engaged in the slot.

The second spaced apart plate sections may be provided with bracket plates extending upwardly from upper edges thereof. The support member comprises a support pin. The support pin is disposed between the bracket plates and supported to the bracket plates. The hook member obliquely extends upwardly from an upper edge of one of the first spaced apart plate sections so as to cross the support pin.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals denote the same parts throughout the Figures and wherein.

DETAILED DESCRIPTION OF THE PREFERRED EMBODIMENTS

Figure 1:
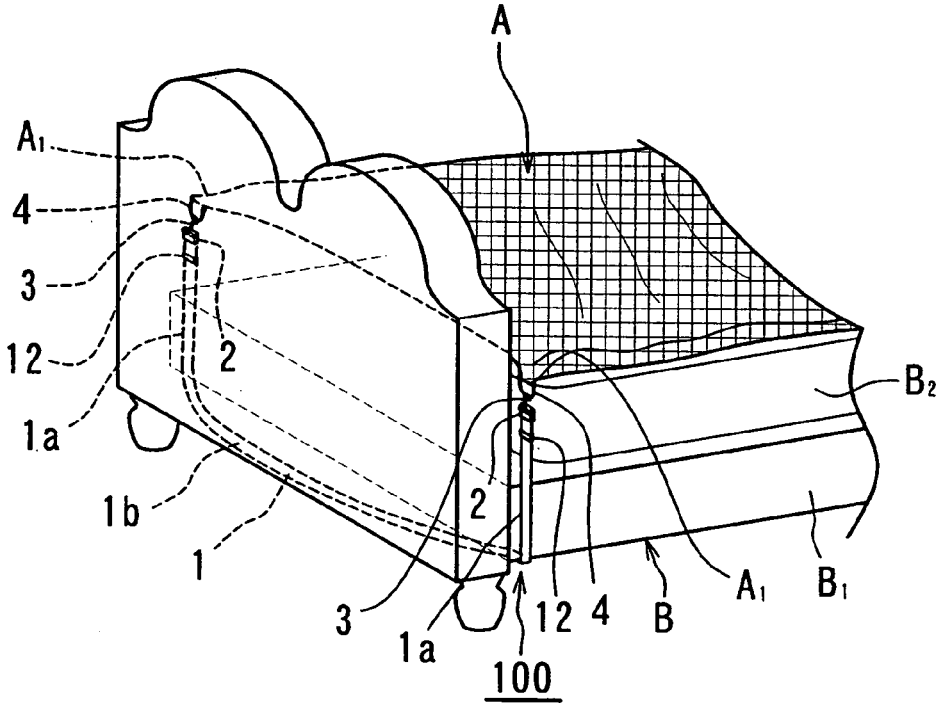
FIG. 1 is a schematic perspective view of a bed to which holding means according to a first embodiment of the present invention is applied, and of assistance in explaining utilization of the holding means.

Referring now to FIG. 1, there is illustrated holding means 100 for use in bedding A, according to a first embodiment of the present invention.

The holding means 100 comprises a flat belt or strap 1, two adjusting devices 2 attached to the belt 1 for adjusting a length of the belt 1, the adjusting devices 2 having hooks 3, and two fastening devices 4 for fastening and holding portions $A_1$ of a periphery of the bedding A. The belt 1 comprises both end sections 1*a*, and a middle section 1*b* between the both end sections 1*b*. The adjusting devices 2 are attached to terminals of the both end sections 1*a* of the belt 1. The belt 1 may be made of rubber, cloth, fabric, textile or the like. At the time of the use of the holding means 100 according to the first embodiment of the present invention, the fastening devices 4 are adapted to be caught by the hooks 3.

A bed B to which the holding means 100 according to the first embodiment of the present invention may be applied comprises a base $B_1$ and a mattress $B_2$ laid on the base $B_1$. The belt 1 has a length longer than a size that includes a width of the bed B plus heights of both sides of the bed B. When the bedding A laid on the mattress $B_2$ is to be held by the holding means 100, the middle section 1*b* of the belt 1 is disposed below a bottom surface of the bed B so as to extend along a crosswise direction of the bed B, the both end sections 1*a* of the belt 1 are wound around both side corners of the bottom surface of the bed B, and the opposite portions $A_1$ of the periphery of the bedding A are held by the fastening devices 4. In this condition, the fastening devices 4 holding the bedding A are caught by the hooks 3, whereby the bedding A is held by the holding means 100 so as to be prevented from being shifted or slipping. Therefore, even if a person in bed moves, for example, turns over in bed, the bedding A is prevented from being shifted or slipping and falling down from the bed owing to the movement of the person. While one holding means 100 is applied to the bedding A in the illustrated example, several holding means 100 may be applied to the bedding A. In this case, the bedding A can be still more securely prevented from being shifted or slipping and falling down from the bed B.

Figure 2:
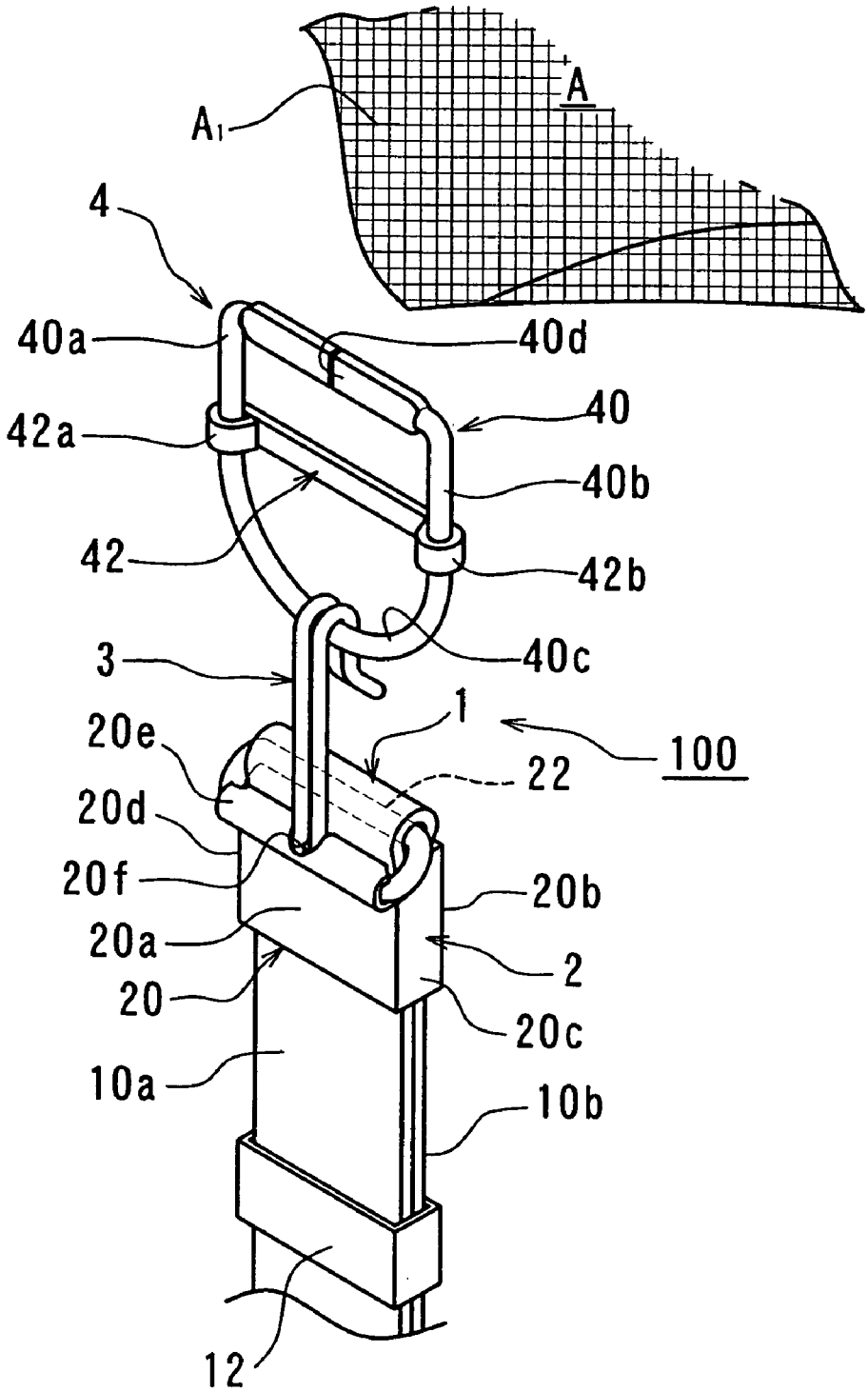
FIG. 2 is a schematic perspective view of the holding means.

Referring now to FIG. 2, there are best illustrated one adjusting device 2 attached to the belt 1, and one fastening device 4.

The fastening device 4 comprises a substantially ring-like body 40 and a holding member 42. In the illustrated example, the ring-like body 40 is formed by bending a metallic round bar into a substantially D-shape, and comprises a pair of first spaced apart axial portions 40*a*, 40*b*, a second axial portion 40*c* disposed between first ends of the first axial portions 40*a*, 40*b* and interconnecting the first axial portions 40*a*, 40*b*, and a third axial portion 40*d* disposed between second ends of the first axial portions 40*a*, 40*b* and interconnecting the first axial portions 40*a*, 40*b*. The second axial portion 40*c* of the ring-like body 40 is formed into a circular arc shape. After the metallic round bar for the ring-like body 40 is formed into a substantially D-shape, the third axial portion 40*d* is formed into an angular flat shape by crashing opposite end portions of the D-shaped ring-like body 40. The holding member 42 is formed from a metallic angular flat plate and provided at both ends thereof with ring-like sections 42*a*, 42*b*. The holding member 42 is bridged between the first spaced apart axial portions 40*a*, 40*b* with the ring-like sections 42*a*, 42*b* thereof being fitted on the first axial portions 40*a*, 40*b*. Each of the ring-like sections 42*a*, 42*b* has an inner diameter slightly larger than a diameter of each of the first axial portions 40*a*, 40*b*, so that the holding member 42 can be slid along the first axial portions 40*a*, 40*b*. By causing the portion $A_1$ of the periphery of the bedding A to be inserted through a space between the third axial portion 40*d* and the holding member 42, and causing the holding member 42 to be slid toward the third axial portion 40*d* along the first axial portions 40*a*, 40*b*, the portion $A_1$ of the bedding A is adapted to be clamped by the holding member 42 and the third axial portion 40*d* as will be discussed in greater detail hereinafter. At the time of the use of the holding means 100, the second axial portion 40*c* of the fastening device 4 is adapted to be caught by the hook 3 of the adjusting device 2 provided at the belt 1.

In the illustrated example, the third axial portion 40*d* of the fastening device 4 is angular and the holding member 42 is also angular, so that when the portion $A_1$ of the bedding A is clamped by the third axial portion 40*d* of the fastening device 4 and the holding member 42, the portion $A_1$ of the bedding A is tightly held by the third axial portion 40*d* of the fastening device 4 and the holding member 42. A space between the first spaced apart axial portions 40*a*, 40*b* of the fastening device 4 may be designed so as to gradually become wide toward the third axial portion 40*d* of the fastening device 4. In this case, when the holding member 42 is slid toward the third axial portion 40*d* along the first axial portions 40*a*, 40*b* and the portion $A_1$ of the bedding A is then clamped by the holding member 42 and the third axial portion 40*d*, the holding member 42 is prevented from being accidentally slid toward the second axial portion 40*c* of the fastening device 4, so that the portion $A_1$ of the bedding A can be securely clamped between the holding member 42 and the third axial portion 40*d* of the fastening device 4.

Incidentally, while the substantially ring-like body 40 of the fastening device 4 is formed into a substantially D-shape in the illustrated example, it may be formed into a square shape or a rectangular shape, for example. Furthermore, while the substantially ring-like body 40 of the fastening device 4 and holding member 42 are formed of metal in the illustrated example, they may be formed of any suitable resin.

Figure 3:
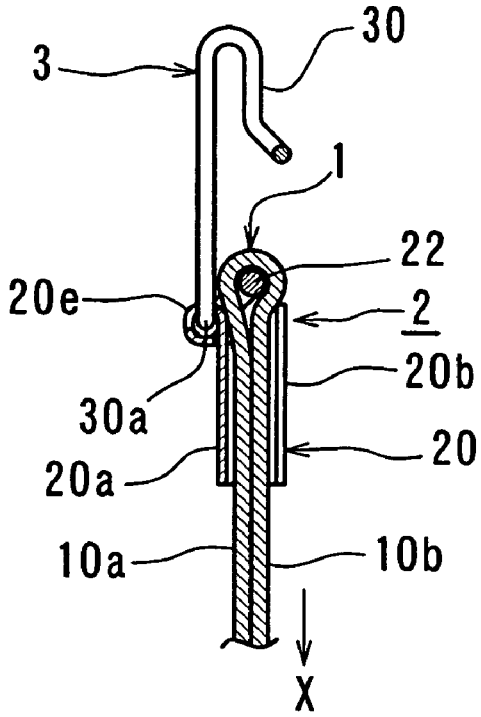
FIG. 3 is a schematic side elevational view partially in section of an adjusting device for adjusting a length of a belt of the holding means.
Figure 4:
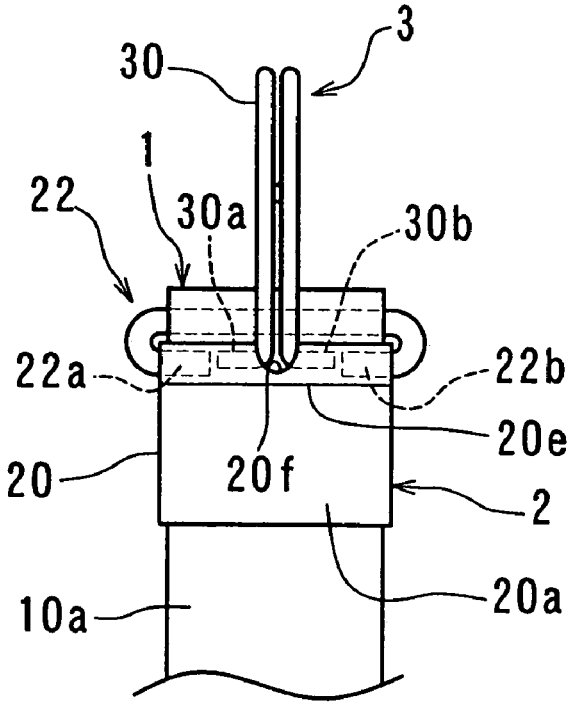
FIG. 4 is a schematic front view of the adjusting device illustrated in FIG. 3.
Figure 5:
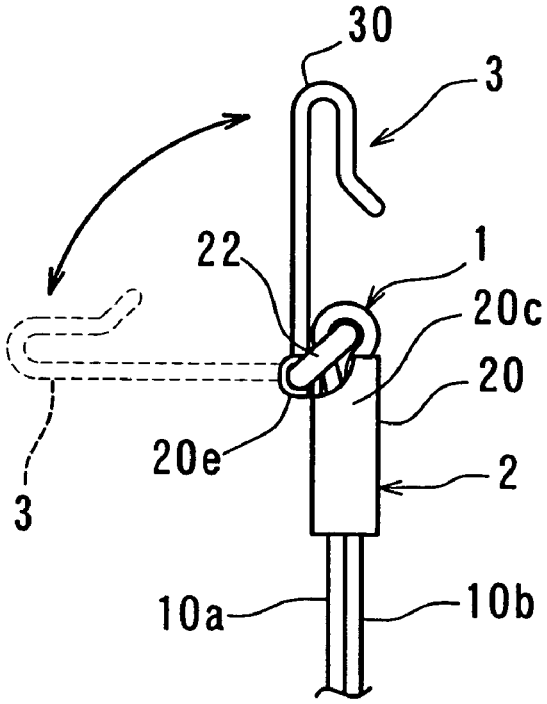
FIG. 5 is a schematic side elevational view of the adjusting device illustrated in FIG. 3 and of assistance in explaining pivotal movement of a hook.

Again referring to FIG. 2, and referring to FIGS. 3 to 5, the adjusting device 2 includes a flat, hollow body 20 of a substantially rectangular parallelepiped-shape through which a terminal of the belt 1 is inserted, and the hook 3. The hollow body 20 of the adjusting device 2 is opened at upper and lower portions thereof and comprises a pair of first spaced apart plate sections 20*a*, 20*b* which face general surfaces of the belt 1, and a pair of second spaced apart plate sections 20*c*, 20*d* interconnecting the first spaced apart plate sections 20*a*, 20*b*. One 20*a* of the first spaced apart plate sections is provided at an upper edge thereof with a cylindrical section 20*e* which extends along the upper edge of the first plate section 20*a* and is projected outwardly laterally from the first plate section 20*a*. The cylindrical section 20*e* is formed at a substantially middle portion thereof with a slot 20*f* which circumferentially extends. As best illustrated in FIG. 4, a support member 22 of a substantially C-shape is pivotally supported to the cylindrical section 20*e* by causing opposite end portions 22*a*, 22*b* of the substantially C-shaped support member 22 to be fitted in both ends of the cylindrical section 20*e*. The hook 3 is formed by bending a metallic wire. More particularly, the hook 3 comprises a twice-folded body 30 of a substantially J-shape, and root sections 30*a*, 30*b* projecting from lower ends of the twice-folded body 30 in the opposite directions to each other. The hook 3 is supported to the cylindrical section 20*e* so as to extend in such a direction as to cross the support member 22, with the root sections 30*a*, 30*b* thereof being engaged in the slot 20*f* of the cylindrical section 20*e*, whereby the hook 3 can be pivoted around the cylindrical section 22*e* as shown in FIG. 5.

The adjusting device 2 is attached to the belt 1 by causing the terminal of the belt 1 to be received in the hollow body 20 through the opened lower portion of the hollow body 20, causing the terminal of the belt 1 to be wound around the support member 22 so as to be folded back, and then drawing the terminal of the belt 1 out of the opened lower end of the hollow body 20. Thus, the terminal of the belt 1 is received through the hollow body 20 in a twice-folded state. As shown in FIG. 2, twice-folded sections 10*a*, 10*b* of the belt 1 are bundled by a ring member 12. When the belt 1 is pulled in such a direction as indicated by an arrow X in FIG. 3, the support member 22 is pivoted in a clockwise direction around the cylindrical section 20*e*, whereby a region of the belt 1 is firmly clamped between the support member 22 and the hollow body 20. A length of the belt 1 can be easily adjusted by controlling drawing amount of the belt 1 from the hollow body 20 of the adjusting device 2.

Figure 6:
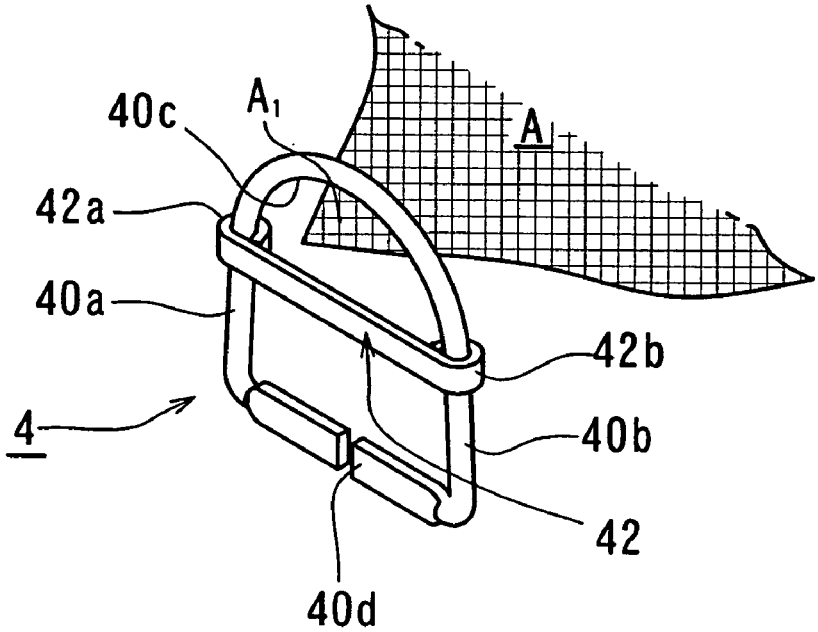
FIGS. 6 to 9 are each a schematic perspective view of assistance in explaining fastening of a portion of bedding by a fastening device of the holding means illustrated in FIG. 2.
Figure 7:
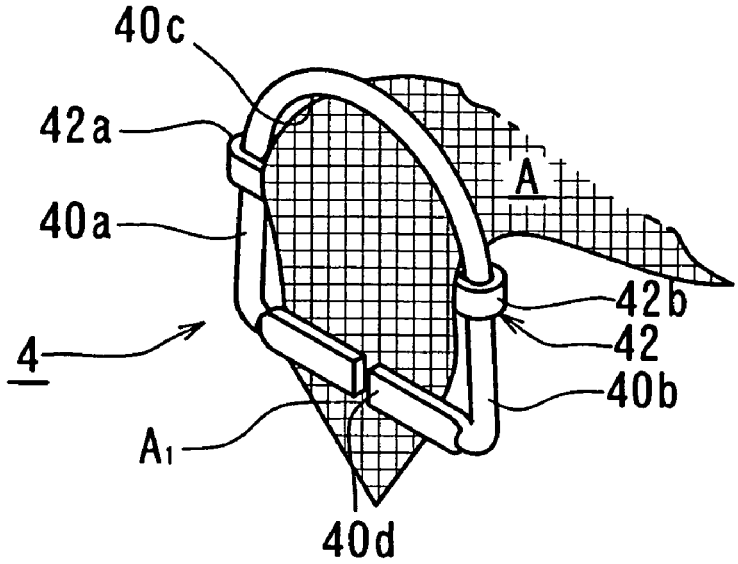
Figure 8:
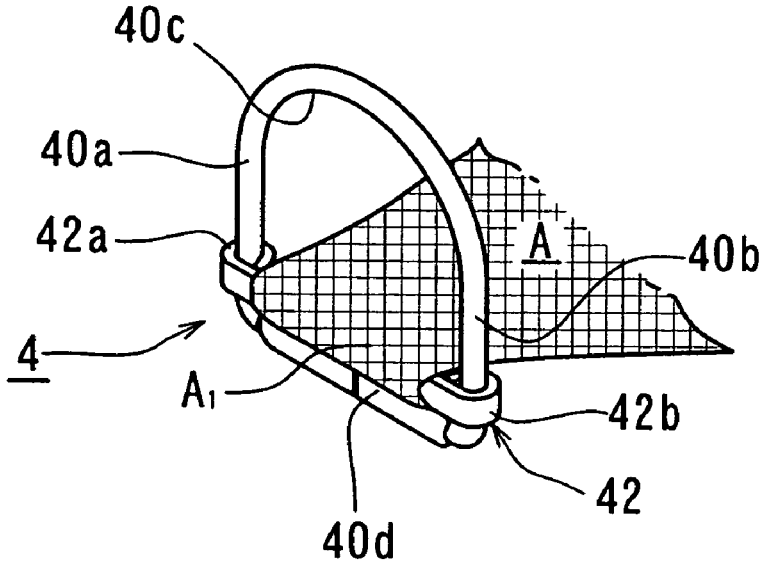
Figure 9:
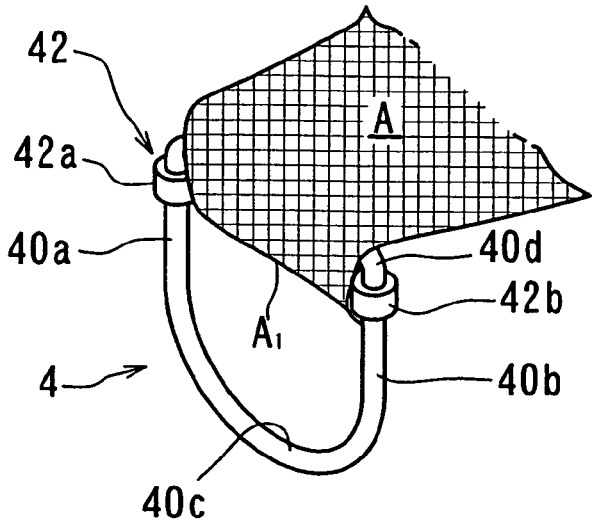

Referring now to FIGS. 6 to 9, utilization of the holding means 100 constructed as described above will be discussed. Fastening of the portion $A_1$ of the bedding A to the fastening device 4 is carried out in such a manner as described hereinafter. First of all, the portion $A_1$ of the bedding A is inserted through a space between the second circular arc-shaped axial portion 40*c* of the fastening device 4 and the holding member 42 in a condition where the second circular arc-shaped axial portion 40*c* of the fastening device 4 is located in an upper position as shown in FIG. 6. The portion $A_1$ of the bedding A is then stridden over the holding member 42 and inserted through a space between the holding member 42 and the third axial portion 40*d* of the fastening device 4 as shown in FIG. 7. In this condition, by causing the holding member 42 to be slid toward the third axial portion 40*d* of the fastening device 4 along the first axial portions 40*a*, 40*b* of the fastening device 4, the portion $A_1$ of the bedding A is clamped between the holding member 42 and the third axial portion 40*d* of the fastening device 4, whereby the portion $A_1$ of the bedding A is fastened to the fastening device 4 as shown in FIG. 8. The fastening device 4 is then turned in such a manner that the circular arc-shaped axial portion 40*c* of the fastening device 4 is located in a lower position, whereby the portion $A_1$, of the bedding A is wound around the third axial portion 40*d* of the fastening device 4 and unremovably fastened to the fastening device 4 as shown in FIG. 9. The two fastening devices 4 holding the portions $A_1$, of the bedding A in this way are caught by the hooks 3 of the adjusting devices 2 attached to the belt 1 that is disposed below the bed B and wound around the lower corners of the bed B as shown in FIG. 1, whereby the bedding A can be positively held by the holding means 100 so as not to be shifted or slip.

Figure 10:
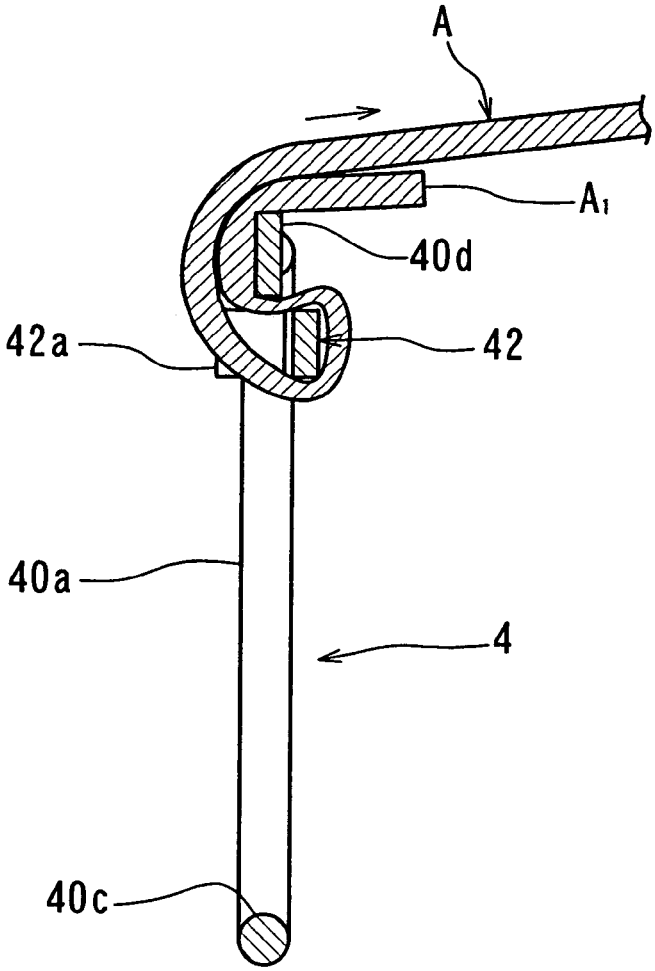
FIG. 10 is a schematic side elevational view partially in section of the fastening device illustrated in FIGS. 6 to 9, and of assistance in explaining a condition where the bedding is pulled.

In the condition where the bedding A is held at the portions $A_1$, thereof by the holding means 100, even if the person in bed moves, for example, turns over to thereby pull the bedding A in such a direction as indicated by an arrow in FIG. 10, the bedding A is not detached from the fastening devices 4 (only one fastening device 4 is shown in FIG. 10), since the portions A1 of the bedding A (only one portion $A_1$ of the bedding A is shown in FIG. 10) are undetachably fastened to the fastening devices 4. In addition, the bedding A can be positively prevented from being shifted or slipping and falling down from the bed, since the fastening devices 4 are caught by the hooks 3 of the adjusting devices 2 provided at the belt 1. Therefore, the person who is sleeping using the bedding held by the holding means 100 according to the present invention will not catch a cold and be able to be comfortably sleeping.

In the holding means 100, the fastening devices 4 are adapted to be caught by the hooks 3 provided at the adjusting devices 2 which serve as means to adjust the length of the belt 1, so that the adjusting of the whole length of the belt 1 and the holding of the bedding A by the fastening devices 4 can be easily performed.

Incidentally, the belt preferably has a length long enough to allow the person to comfortably sleep without being oppressed by the holding means 100. In the illustrated example, the belt 1 provided with the adjusting devices 2 for adjusting the whole length of the belt is employed as one of elements making-up the holding means 100 according to the present invention. The belt 1 may be also used as a belt for bundling any loads, and a hanging belt for a shoulder bag or the like.

Figure 11:
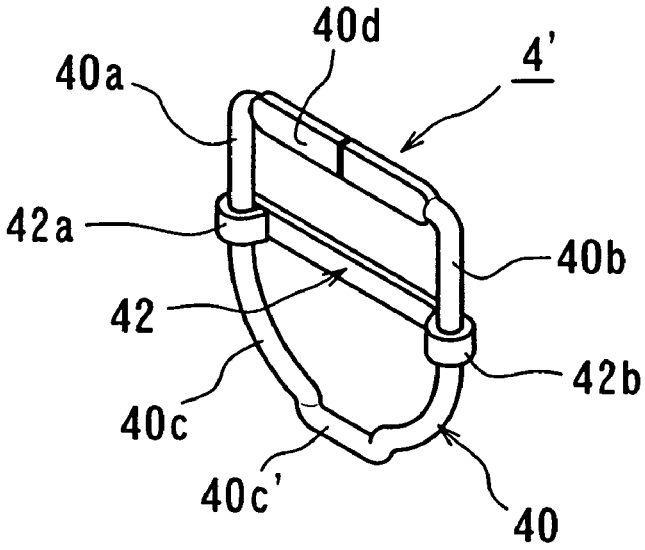
FIG. 11 is a schematic perspective view of a modification of the fastening device illustrated in FIG. 2.

Referring to FIG. 11, there is illustrated a modification 4' of the fastening device 4. The fastening device 4' shown in FIG. 11 is substantially similar to the fastening device 4 of FIG. 2 except that the second circular arc-shaped axial portion 40*c* is provided at a substantially middle region thereof with a recessed region 40*c*'. In FIG. 11, parts of the fastening device 4' that are similar to those of the fastening device 4 shown in FIG. 2 are denoted with like reference numerals. In the modification, the hook is adapted to be tightly engaged with the recessed region 40*c*' of the fastening device 4', whereby the fastening device 4' can be securely positioned with respect to the hook without moving.

Figure 12:
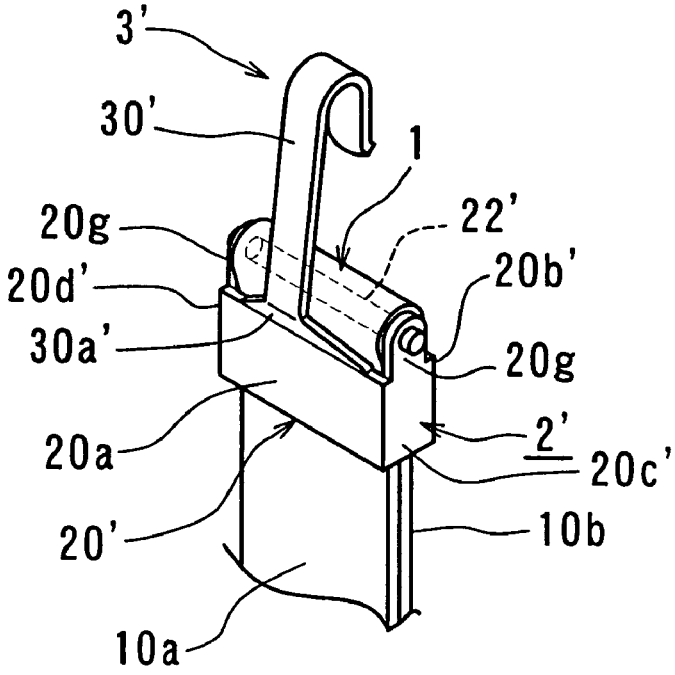
FIG. 12 is a schematic perspective view of a modification of the adjusting device illustrated in FIG. 2.
Figure 13:
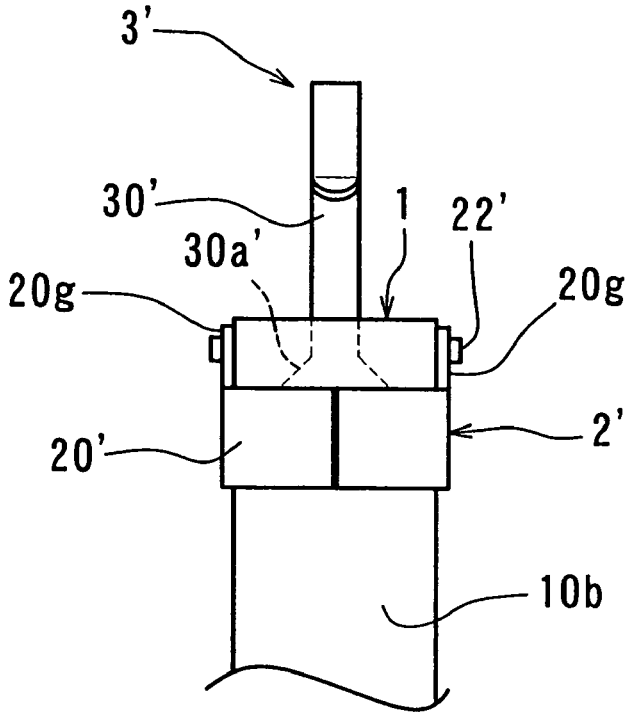
FIG. 13 is a schematic front view of the adjusting device illustrated in FIG. 12.
Figure 14:
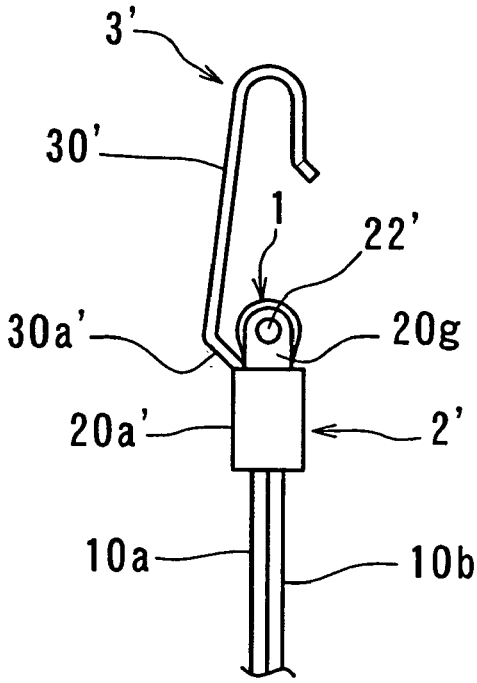
FIG. 14 is a schematic side elevational view of the adjusting device illustrated in FIG. 12.

Referring to FIGS. 12 to 14, there is illustrated a modification 2' of the adjusting device 2. The adjusting device 2' includes a flat, hollow body 20' of a substantially rectangular parallelepiped-shape through which the terminal of the belt 1 is received, and a hook 3' formed integrally with the hollow body 20'. The hollow body 20' of the adjusting device 2' is opened at upper and lower portions thereof and comprises a pair of first spaced apart plate sections 20*a*', 20*b*' which face general surfaces of the belt 1, and a pair of second spaced apart plate sections 20*c*', 20*d*' interconnecting the first spaced apart plate sections 20*a*', 20*b*'. The second plate sections 20*c*', 20*d*' are provided with bracket plates 20*g* that extend upwardly from upper edges of the second plate sections 20*c*', 20*d*'. A support pin 22' is disposed between the bracket plates 20*g* and supported to the bracket plates 20*g*. The hook 3' extends upwardly from an upper edge of one 20*a*' of the first spaced apart plate sections. As best shown in FIG. 14, the hook 3' comprises a root portion 30*a*' obliquely extending upwardly from the upper edge of the first plate section 20*a*' of the hollow body 20' in a such a direction as to be away from the hollow body 20', and a substantially J-shaped narrow piece 30' obliquely extending upwardly from an upper edge of the root portion 30*a*' in such a direction as to cross the support pin 22'. In the modification shown in FIGS. 12 to 14, the terminal of the belt 1 is received in the hollow body 20' through the lower opened end of the hollow body 20', wound around the support pin 22' so as to be folded back and then drawn out of the lower opened end of the hollow body 20'. The fastening device is adapted to be caught by the substantially J-shaped narrow piece 30'.

Figure 15:
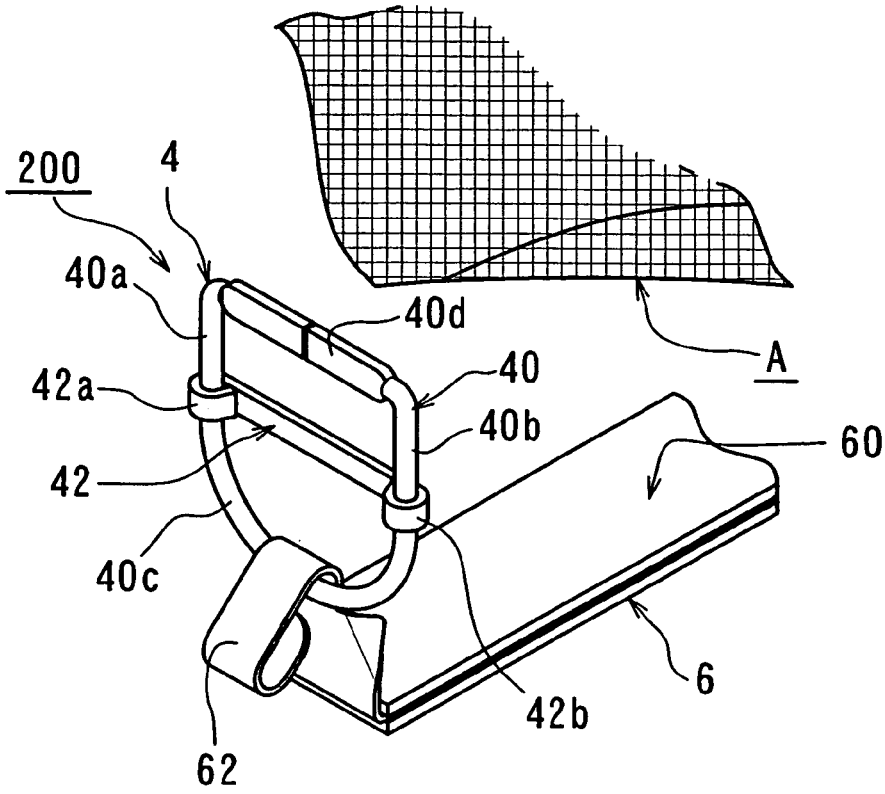
FIG. 15 is a schematic perspective view of holding means according to a second embodiment of the present invention.
Figure 16:
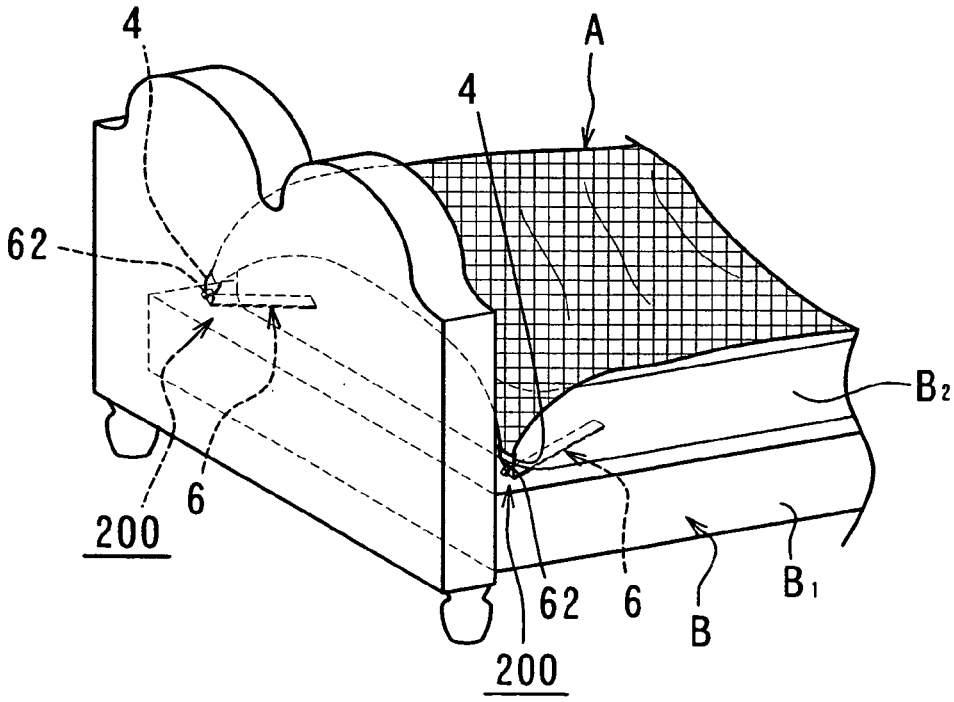
FIG. 16 is a schematic perspective view of a bed to which the holding means of FIG. 15 is applied, and of assistance in explaining utilization of the holding means illustrated in FIG. 15.

Referring now to FIGS. 15 and 16, there is illustrated holding means 200 according to a second embodiment of the present invention. The second embodiment is substantially similar to the holding means 100 shown in FIG. 2 except that hook means 6 is employed in lieu of the belt 1 provided with the adjusting devices 2. In FIGS. 15 and 16, elements of the holding means 200 that are similar to those of the holding means 100 according to the first embodiment are designated with like reference numerals. The description of them will not be repeated.

The hook means 6 comprises a strip-like body 60 and a hooking section 62 provided at an end of the strip-like body 60. The strip-like body 60 has a length of about 21.5 cm., a width of about 2.5 cm., and a thickness of about 0.6 cm. As shown in FIG. 16, the bedding A is adapted to be held by several holding means 200 according to the second embodiment of the present invention, and the hook means 6 and the fastening devices 4 are adapted to be used in several pairs. More particularly, when the bedding A is to be held by the several holding means 200, the several hook means 6 are adapted to be inserted between the bed base $B_1$ and the mattress $B_2$ on the bed base $B_1$ and located at suitable positions between the bed base $B_1$ and the mattress $B_2$. The fastening devices 4 holding the portions $A_1$ of the bedding A in such a manner as described above in connection with the first embodiment are caught by hooking sections 62 of the several hook means 6 inserted between the bed base $B_1$ and the mattress $B_2$, whereby the bedding A can be positively held by the several holding means 200 so as to be prevented from being shifted or slipping. During the person is sleeping using the bedding A held by the holding means 200, the several hook means 6 interposed between the bed base $B_1$ and the mattress $B_2$ are pressed down against the bed base $B_1$ by the weight of the person's body, so that the several hook means 6 are prevented from moving between the bed base $B_1$ and the mattress $B_2$. Also, the several hook means 6 are prevented from being moved between the bed base $B_1$ and the mattress $B_2$ due to frictional resistance which is produced between the hook means 6, and the bed base $B_1$ and the mattress $B_2$.

Figure 17:
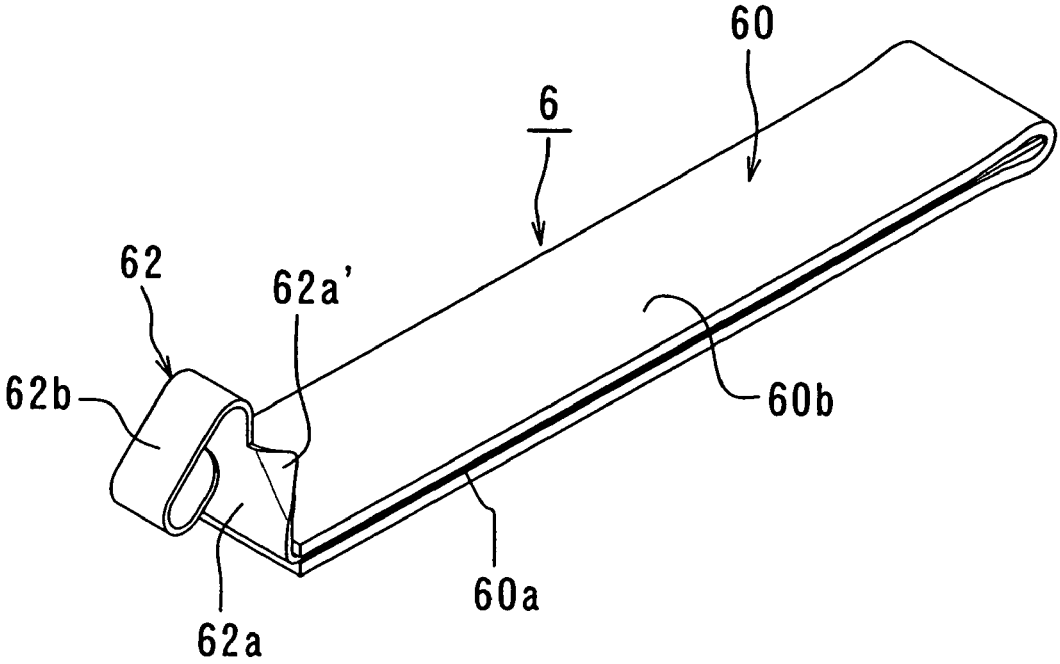
FIG. 17 is a schematic perspective view of hook means of the holding means illustrated in FIG. 15.
Figure 18:
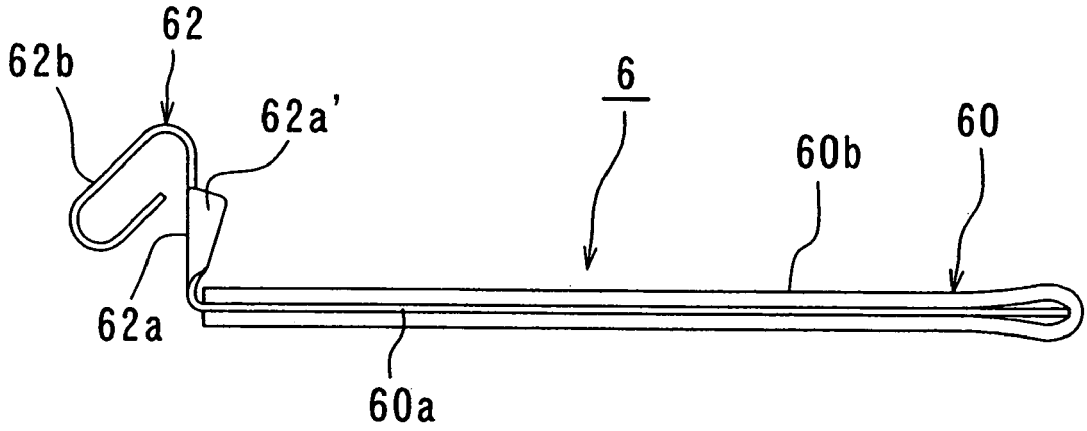
FIG. 18 is a schematic side elevational view of the hook means illustrated in FIG. 17.

Referring now to FIGS. 17 and 18, the strip-like body 60 of the hook means 6 comprises a strip-like core 60*a* and a coating layer 60*b* coating the strip-like core 60*a*. In the illustrated example, the length of the coating layer 60*b* is substantially twice the length of the strip-like core 60*a*. The coating layer 60*b* is twice-folded, between which the strip-like core 60*a* is sandwiched, and bonded onto both general surfaces of the strip-like core 60*a* with, for example, any suitable adhesive. The strip-like core 60*a* is made from a metal plate. The hooking section 62 is formed by bending and cutting one end portion of the metal plate. The hooking section 62 has a rising root portion 62*a* bent at an angle of about 90 degrees relative to the general surface of the strip-like core 60*a*, and a substantially loop-like narrow piece 62*b* obliquely extending downwardly from an upper edge of the root portion 62*a* in such a direction as to be away from the strip-like core 60*a*. The rising root portion 62*a* has reinforcing pieces 62*a*' that are provided at both sides of the rising portion 62*a* and projected in a direction opposite to the extending direction of the loop-like narrow piece 62*b*.

While the whole strip-like core 60*a* including the hooking section 62 is made of metal in the illustrated example, it may be formed of hard resin having suitable hardness. The coating layer 60*b* is preferably made of any suitable material having a high frictional resistance coefficient. As such material for the coating layer 60*b*, there may be employed rubber, non woven fabric, resin having a high frictional resistance coefficient, or the like. In the case where the coating layer 60*b* is made of material having a high frictional resistance coefficient, when the hook means 6 is interposed and located between the bed base $B_1$ and the mattress $B_2$, the hook means 6 can be still more securely prevented from moving between the bed base $B_1$ and the mattress $B_2$. The strip-like core 60*a* may be coated at only one general surface thereof with a coating layer having a size corresponding to a size of the general surface of the strip-like core 60*a*. In this case, the coating layer 60*b* is preferably bonded onto one general surface of the strip-like core 60*a* that is to be opposed to a surface of the bed base $B_1$ when the hook means 6 is interposed and located between the bed base $B_1$ and the mattress $B_2$. Furthermore, the whole strip-like core 60*a* may be formed of any suitable hard and rigid material having a high frictional resistance coefficient. In this case, the coating layer 60*b* can be omitted.

Figure 19:
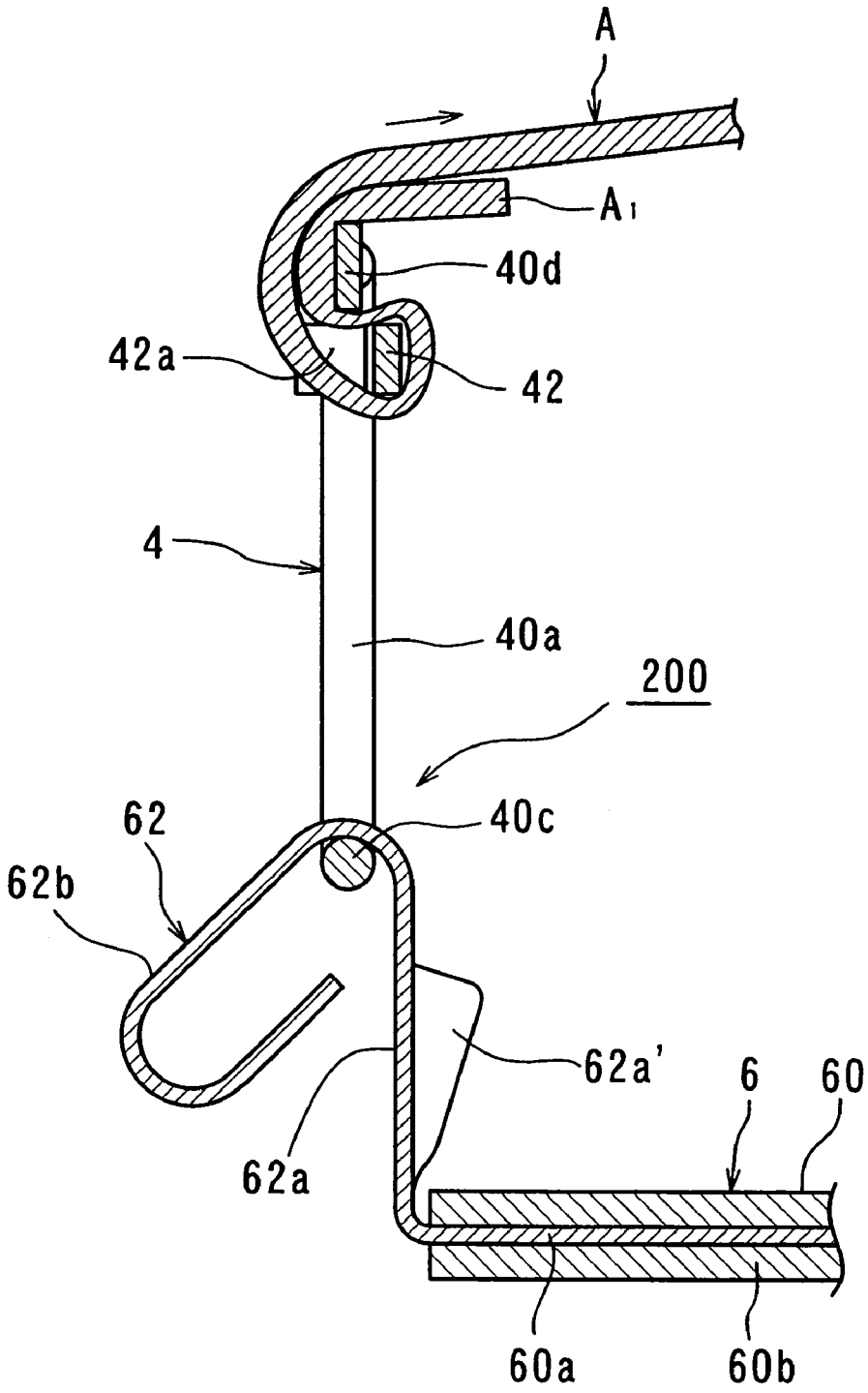
FIG. 19 is a schematic side elevational view partially in section of the holding means illustrated in FIG. 15.

When holding of the bedding A is to be performed utilizing the holding means 200 that is constructed as described above, several holding means 200 according to the second embodiment are employed. The strip-like bodies 60 of the several hook means 6 are interposed between the bed base $B_1$ and the mattress $B_2$ and located at suitable positions between the bed base $B_1$ and the mattress $B_2$ as shown in FIG. 16. In this condition, as illustrated in 19, the fastening devices 4 (only one fastening device 4 is shown in FIG. 19) holding the portions $A_1$ of the periphery of the bedding A (only one portion $A_1$ is shown in FIG. 19) in such a manner as described above in connection with the first embodiment are caught by the loop-like narrow pieces 62*b* of the several hook means 6 (only one hook means 6 is shown in FIG. 19), whereby the bedding A can be securely held by the several holding means 200 so as to be prevented from being shifted or slipping. In the condition where the portions $A_1$ of the bedding A are held by the several holding means 200, even if the person in bed moves, for example, turns over, to thereby pull the bedding A in such a direction as indicated by an arrow in FIG. 19, the bedding A can be positively prevented from being shifted or slipping and falling down from the bed, since the fastening devices 4 holding the bedding A are caught by the loop-like narrow pieces 62*b* of the several hook means 6 interposed between the bed base $B_1$ and the mattress $B_2$.

Figure 20:
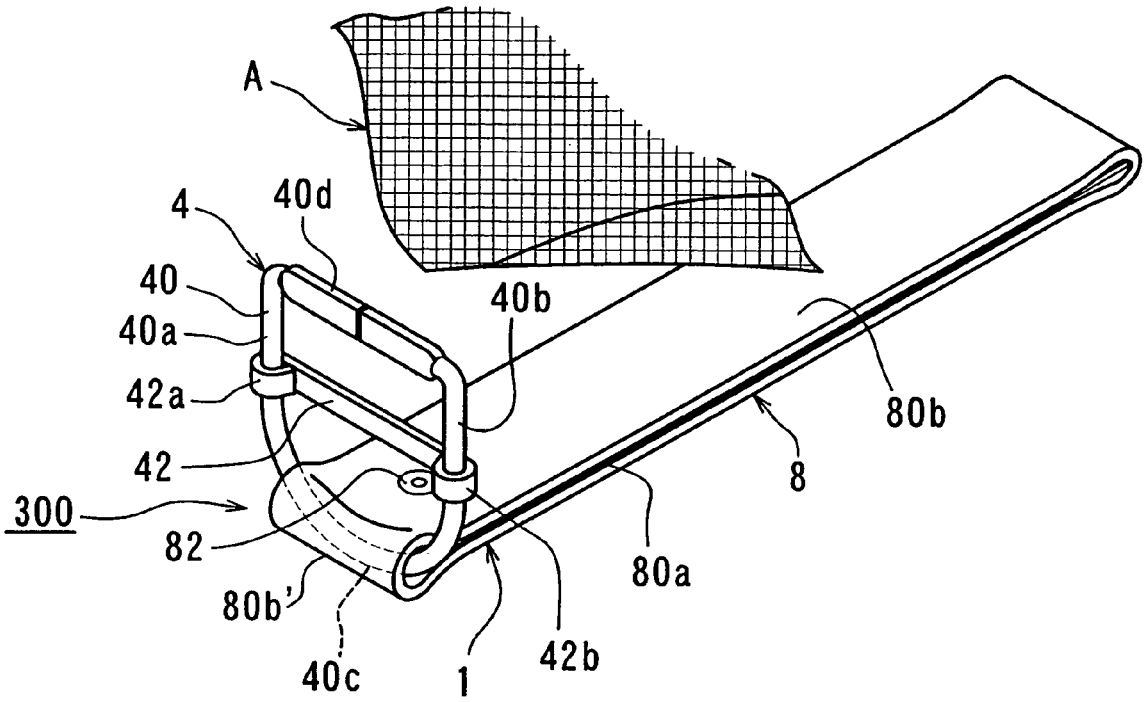
FIG. 20 is a schematic perspective view of holding means according to a third embodiment of the present invention.
Figure 21:
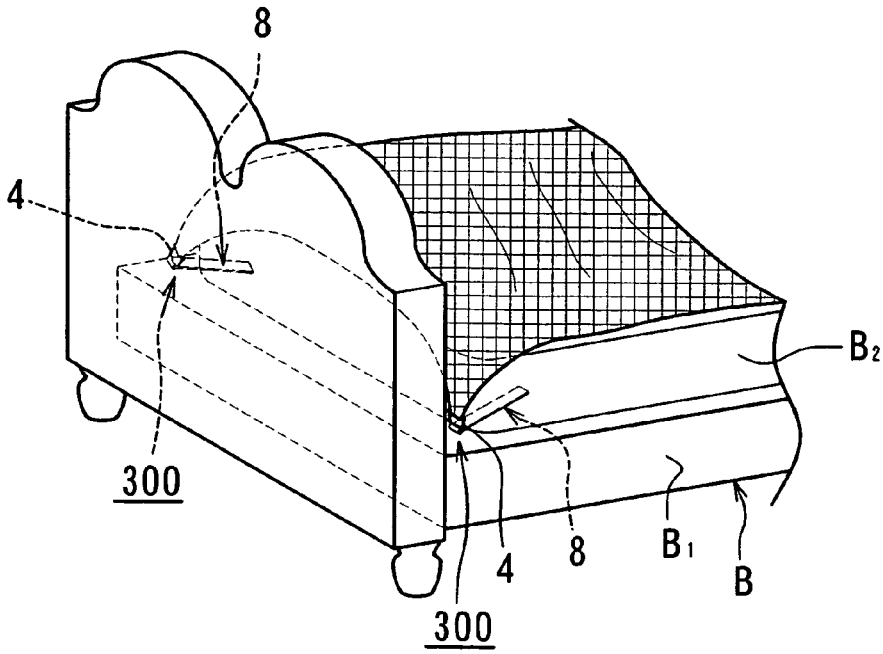
FIG. 21 is a schematic perspective view of a bed to which the holding means illustrated in FIG. 20, and of assistance in explaining utilization of the holding means of FIG. 20.
Figure 22:
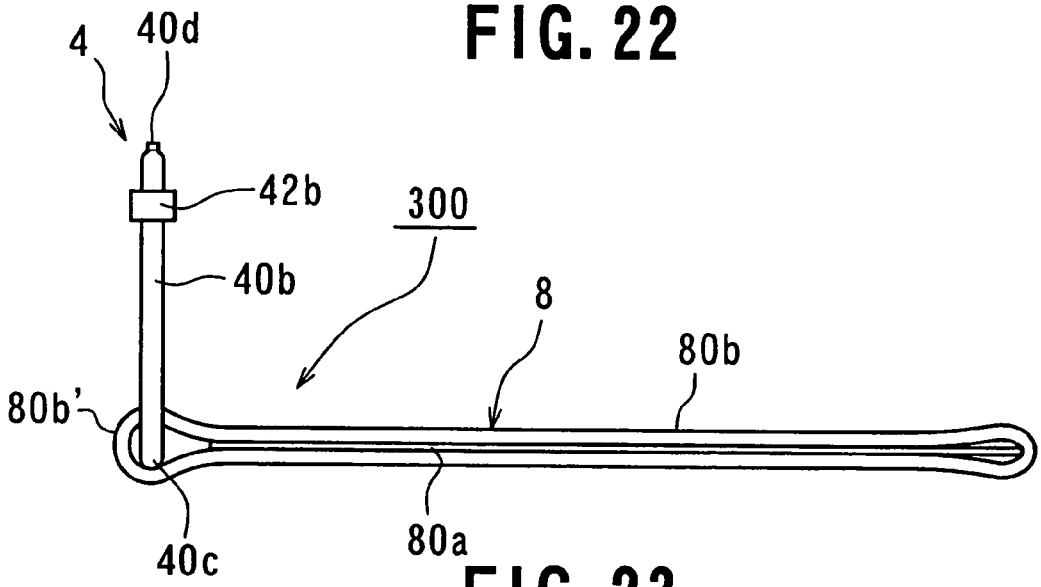
FIG. 22 is a schematic side elevational view of the holding means illustrated in FIG. 20.

Referring to FIGS. 20 to 22, there is illustrated holding means 300 according to a third embodiment of the present invention. The third embodiment is substantially similar to the holding means 200 shown in FIG. 15 except that the hook means is omitted and the fastening device 4 is provided integrally at a strip-like body 8. In FIGS. 20 to 22, elements of the holding means 300 that are similar to those of the holding means 200 are denoted with like reference numerals. The description of them will not be repeated.

When the bedding A is to be held by the holding means 300 according to the third embodiment of the present invention, several holding means 300 which are employed. The several holding means 300 are adapted to be interposed between the bed base $B_1$ and the mattress $B_2$ and located at suitable positions between the bed base $B_1$ and the mattress $B_2$. During the person is sleeping using the bedding A held by the holding means 300, the several holding means 300 interposed between the bed base $B_1$ and the mattress $B_2$ are pressed down against the bed base $B_1$ by the weight of the person's body, so that the several holding means 300 are prevented from moving between the bed base $B_1$ and the mattress $B_2$.

The strip-like body 8 has a length of about 21.5 cm., a width of about 2.5 cm. and a thickness of about 0.6 cm, and comprises a strip-like core 80*a* and an endless belt-like coating layer 80*b*. The strip-like core 80*a* is made from a metal plate. The strip-like core 80*a* is disposed in the endless belt-like coating layer 80*b* and bonded at both general surfaces thereof to the coating layer 80*b* with, for example, any suitable adhesive. The endless belt-like layer 80*b* is provided with a loop-like support section 80*b*' that is not bonded to the strip-like core 80*a*. The second circular arc-shaped axial portion 40*c* of the fastening device 4 is received through the loop-like support section 80*b*', whereby the fastening device 4 is pivotally supported to the support section 80*b*'. The coating layer 80*b* and the strip-like core 80*a* are fastened together at portions thereof adjacent the loop-like support section 80*b* with a rivet 82 penetrating the strip-like body 80 in a thickness direction, whereby the coating layer 80*b* can be prevented from peeling from the strip-like core 80*a*.

While the strip-like core 80*a* is made of metal in the illustrated example, it may be formed of hard resin having suitable hardness. The coating layer 80*b* is preferably made of any suitable material having a high frictional resistance coefficient. As such material for the coating layer 80*b*, there may be employed rubber, non woven fabric, resin having a high frictional resistance coefficient, or the like. In the case where the coating layer 80*b* is made of material having a high frictional resistance coefficient, when the strip-like body 8 is interposed and located between the bed base $B_1$ and the mattress $B_2$ as shown FIG. 21, the strip-like body 8 can be still more securely prevented from moving between the bed base B1 and the mattress $B_2$. The strip-like core 80*a* may be coated at only one general surface thereof with a coating layer that is not endless and has a length corresponding to a length of the strip-like core 80*a*. In this case, the loop-like support section 82 may be provided at an end of the strip-like core 60*a* or an end of such a coating layer. The coating layer that is not endless is preferably bonded onto one general surface of the strip-like core 80*a* that is opposed to a surface of the bed base $B_1$ when the strip-like body 8 is interposed and located between the bed base $B_1$ and the mattress $B_2$. Furthermore, the whole strip-like core 60*a* may be formed of any suitable hard and rigid material having a high frictional resistance coefficient. In this case, the coating layer can be omitted.

Figure 23:
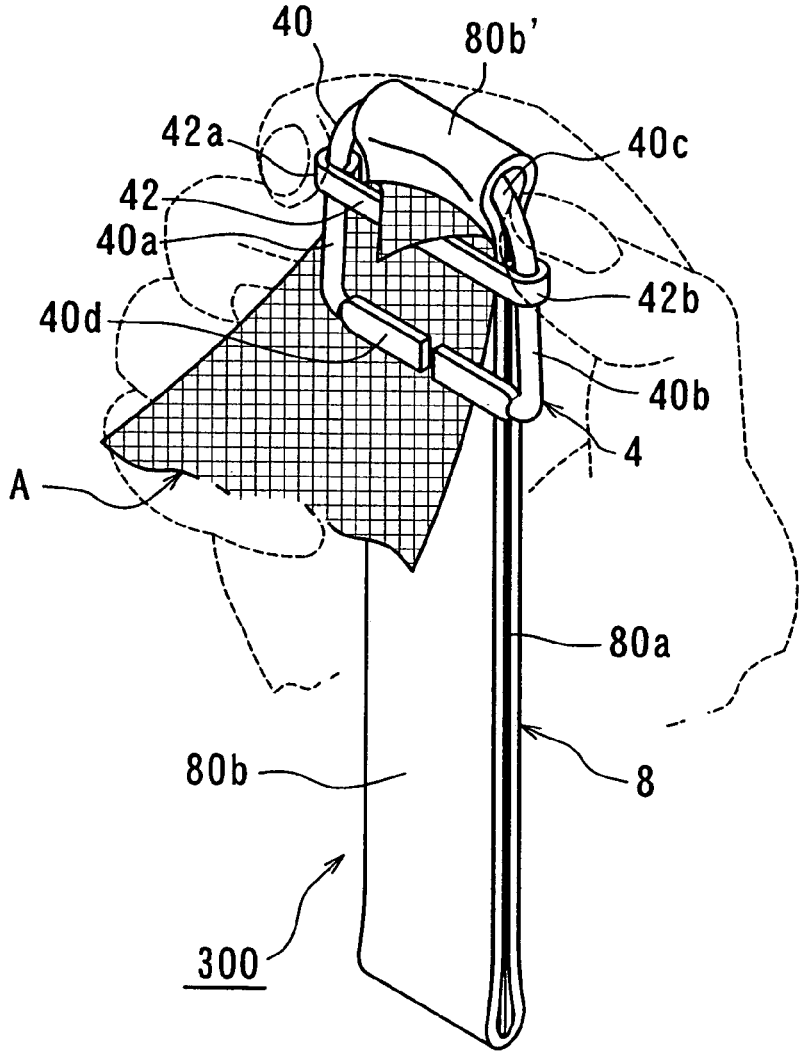
FIG. 23 to 26 are each a schematic perspective view of the holding means illustrated in FIG. 20 and of assistance in explaining holding of a portion of bedding by the holding means illustrated in FIG. 20.
Figure 24:
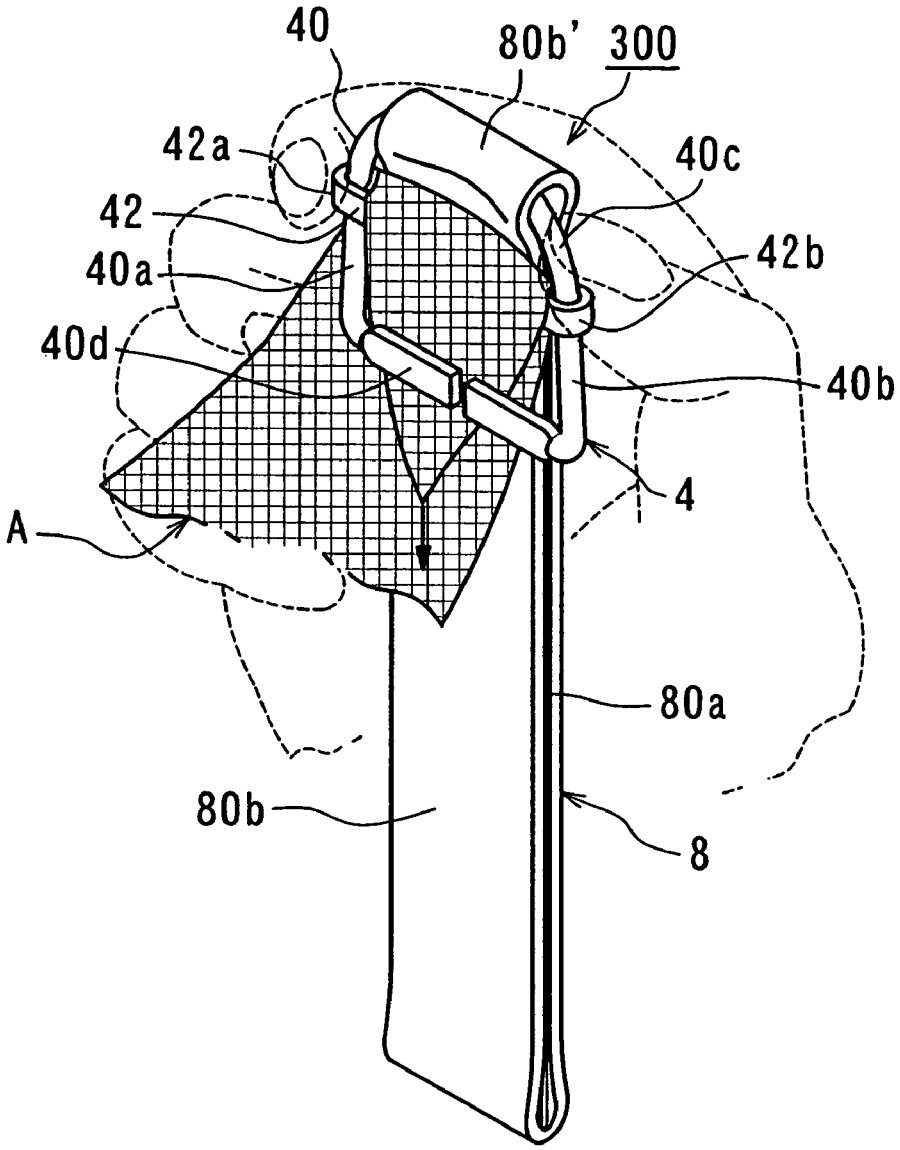
Figure 25:
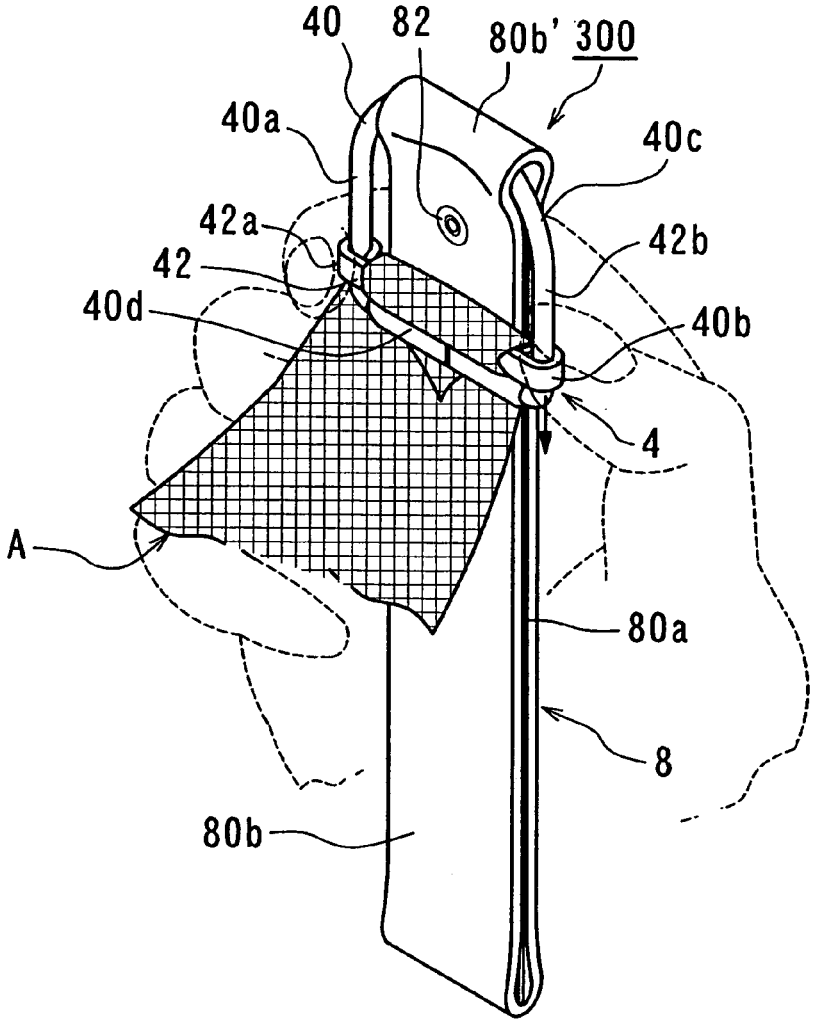
Figure 26:
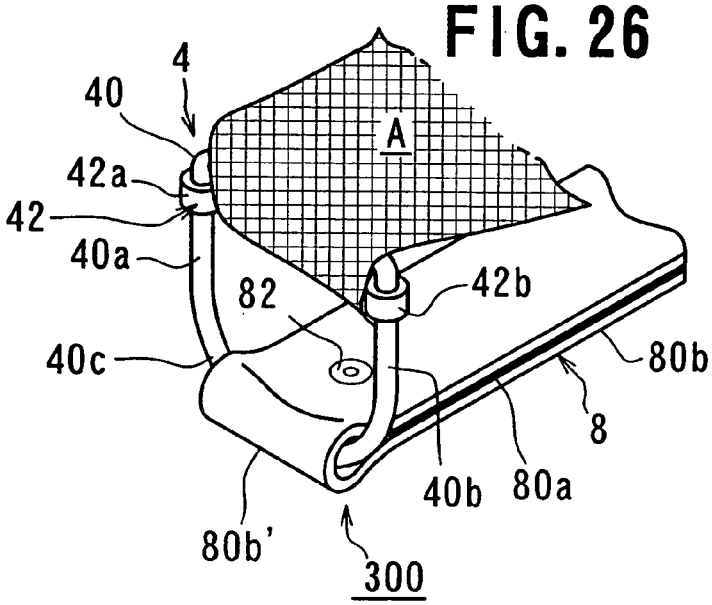

Referring now to FIGS. 23 to 26, utilization of the holding means 300 constructed as described above will be discussed. First of all, the portion $A_1$ of the bedding A is inserted through the space between the second circular arc-shaped axial portion 40*c* of the fastening device 4 and the holding member 42 in a condition where the second circular arc-shaped axial portion 40*c* of the fastening device 4 is located in an upper position and the person holds the first spaced apart axial portions 40*a*, 40*b* with fingers of the person as shown in FIG. 23. The portion $A_1$ of the bedding A is then stridden over the holding member 42 and inserted through the space between the holding member 42 and the third axial portion 40*d* of the fastening device as shown in FIG. 24. In this state, by causing the holding member 42 to be slid toward the third axial portion 40*d* of the fastening device 4, the portion $A_1$ of the bedding A is clamped between the holding member 42 and the third axial portion 40*d* of the fastening device 4, whereby the portion $A_1$ of the bedding A is fastened to the fastening device 4 as shown in FIG. 25. The fastening device 4 is then pivoted in such a manner that the circular arc-shaped axial portion 40*c* of the fastening device 4 is located in a lower position, whereby the portion $A_1$ of the bedding A is wound around the third axial portion 40*d* of the fastening device 4 and undetachably fastened to the fastening device 4 as shown in FIG. 26. The several holding means 300 holding the portions $A_1$ of the bedding A in this way are inserted and located at suitable positions between the bed base $B_1$ and the mattress $B_2$ as shown in FIG. 21, whereby the bedding A is firmly held by the holding means 300 so as not to be shifted or slip. In this condition, as discussed above, the strip-like bodies 8 of the several holding means 300 are pressed down against the bed base $B_1$ by the weight of the body of the person sleeping, whereby the holding means 300 are prevented from moving between the bed base $B_1$ and the mattress $B_2$. Also, the strip-like bodies 8 are prevented from moving between the bed base $B_1$ and the mattress $B_2$ due to frictional resistance that is produced between the strip-like bodies 8, and the bed base $B_1$ and the mattress $B_2$.

Figure 27:
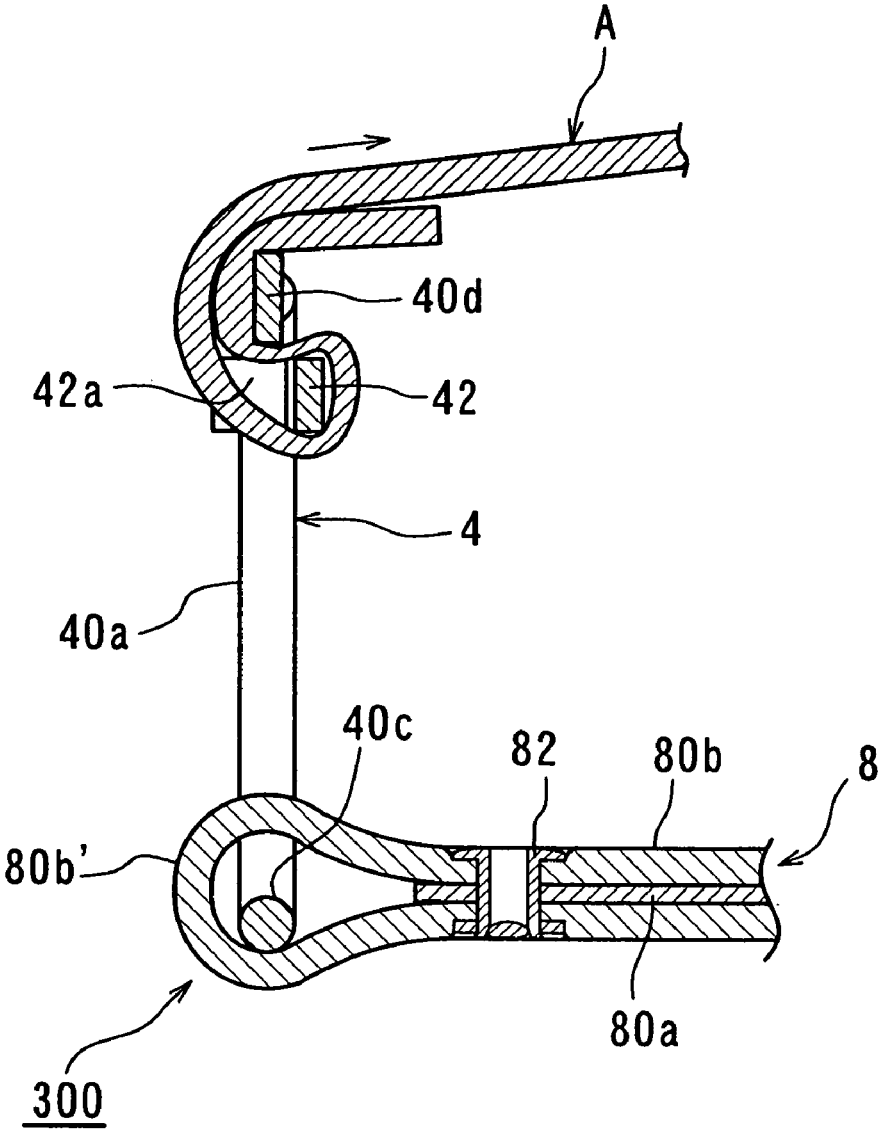
FIG. 27 is a schematic side elevational view partially in section of the holding means of FIG. 20 in use.

In the condition where the bedding A is held at the portions $A_1$ thereof by the several holding means 300, even if the person in bed moves, for example, turns over to thereby pull the bedding A in such a direction as indicated by an arrow in FIG. 27, the bedding A is not detached from the several holding means 300 (only one holding means 300 is shown in FIG. 27), since the portions $A_1$ of the bedding A (only one portion $A_1$ of the bedding A is shown in FIG. 27) are undetachably fastened to the fastening devices 4 (only one fastening device 4 is shown in FIG. 27).

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Holding means for use in bedding, comprising:

a body adapted to be interposed and located between a bed base and a mattress on said bed base; and a fastening means pivotally supported to said body for holding and fastening a portion of a periphery of said bedding;

said fastening means comprising:

a substantially ring-shaped body comprising a pair of first spaced apart portions having first ends and second ends, a second portion disposed between said first ends of said first spaced apart portions and interconnecting said first spaced apart portions, and a third portion disposed between said second ends of said first spaced apart portions and interconnecting said first spaced apart portions; and a holding member bridged between said first spaced apart portions so as to be slidable along said first spaced apart portions, wherein said bedding is fastened and held by causing said portion of said bedding to be inserted through a first space between said second portion of said fastening means and said holding member in a condition where said second portion of said fastening means is located in an upper position, causing said portion of said bedding to be stridden over said holding member, causing said portion of said bedding to be inserted through a second space between said holding member and said third portion of said fastening means, causing said holding member to be slid toward said third portion of said fastening means along said first spaced apart portions of said fastening means, to thereby clamp said portion of said bedding by said holding member and said third portion of said fastening means, and causing said fastening means to be turned in such a manner that said second portion of said fastening means is located in a lower position, to thereby cause said portion of said bedding to be wound around said third portion of said fastening means.

2. Holding means according to claim 1, wherein a space between said first spaced apart portions of said fastening means is designed so as to gradually become wide toward said third portion of said fastening means.

3. Holding means according to claim 1, wherein said fastening means is pivotally supported at said second portion thereof to said body of said holding means.

4. Holding means according to claim 2, wherein said fastening means is pivotally supported at said second portion thereof to said body of said holding means.

5. Holding means according to claim 1, wherein said holding member and said third portion of said fastening means are angular.

6. Holding means according to claim 2, wherein said holding member and said third portion of said fastening means are angular.

7. Holding means according to claim 3, wherein said holding member and said third portion of said fastening means are angular.

8. Holding means according to claim 4, wherein said holding member and said third portion of said fastening means are angular.

9. Holding means according to claim 1, wherein said body of said holding means is shaped like a strip, said fastening means being supported at said second portion thereof to one end of said strip-shaped body.

10. Holding means according to claim 2, wherein said body of said holding means is shaped like a strip, said fastening means being supported at said second portion thereof to one end of said strip-shaped body.

11. Holding means according to claim 3, wherein said body of said holding means is shaped like a strip, said fastening means being supported at said second portion thereof to one end of said strip-shaped body.

12. Holding means according to claim 4, wherein said body of said holding means is shaped like a strip, said fastening means being supported at said second portion thereof to one end of said strip-shaped body.

13. Holding means according to claim 5, wherein said body of said holding means is shaped like a strip, said fastening means being supported at said second portion thereof to one end of said strip-shaped body.

14. Holding means according to claim 6, wherein said body of said holding means is shaped like a strip, said fastening means being supported at said second portion thereof to one end of said strip-shaped body.

15. Holding means according to claim 7, wherein said body of said holding means is shaped like a strip, said fastening means being supported at said second portion thereof to one end of said strip-shaped body.

16. Holding means according to claim 8, wherein said body of said holding means is shaped like a strip, said fastening means being supported at said second portion thereof to one end of said strip-shaped body.

17. Holding means according to claim 9, wherein said strip-shaped body is made of material having a high frictional resistance coefficient.

18. Holding means according to claim 10, wherein said strip-shaped body is made of material having a high frictional resistance coefficient.

19. Holding means according to claim 11, wherein said strip-shaped body is made of material having a high frictional resistance coefficient.

20. Holding means according to claim 12, wherein said strip-shaped body is made of material having a high frictional resistance coefficient.

21. Holding means according to claim 13, wherein said strip-shaped body is made of material having a high frictional resistance coefficient.

22. Holding means according to claim 14, wherein said strip-shaped body is made of material having a high frictional resistance coefficient.

23. Holding means according to claim 15, wherein said strip-shaped body is made of material having a high frictional resistance coefficient.

24. Holding means according to claim 16, wherein said strip-shaped body is made of material having a high frictional resistance coefficient.

25. Holding means according to claim 1, wherein said body of said holding means comprises a strip-shaped core, and a coating layer coating at least one general surface of said strip-shaped core, said coating layer being made of material having a high frictional resistance coefficient.

26. Holding means according to claim 2, wherein said body of said holding means comprises a strip-shaped core, and a coating layer coating at least one general surface of said strip-shaped core, said coating layer being made of material having a high frictional resistance coefficient.

27. Holding means according to claim 3, wherein said body of said holding means comprises a strip-shaped core, and a coating layer coating at least one general surface of said strip-shaped core, said coating layer being made of material having a high frictional resistance coefficient.

28. Holding means according to claim 4, wherein said body of said holding means comprises a strip-shaped core, and a coating layer coating at least one general surface of said strip-shaped core, said coating layer being made of material having a high frictional resistance coefficient.

29. Holding means according to claim 5, wherein said body of said holding means comprises a strip-shaped core, and a coating layer coating at least one general surface of said strip-shaped core, said coating layer being made of material having a high frictional resistance coefficient.

30. Holding means according to claim 6, wherein said body of said holding means comprises a strip-shaped core, and a coating layer coating at least one general surface of said strip-shaped core, said coating layer being made of material having a high frictional resistance coefficient.

31. Holding means according to claim 7, wherein said body of said holding means comprises a strip-shaped core, and a coating layer coating at least one general surface of said strip-shaped core, said coating layer being made of material having a high frictional resistance coefficient.

32. Holding means according to claim 8, wherein said body of said holding means comprises a strip-shaped core, and a coating layer coating at least one general surface of said strip-shaped core, said coating layer being made of material having a high frictional resistance coefficient.

33. Holding means according to claim 1, wherein said body of said holding means comprises a strip-shaped core, and an endless belt-shaped coating layer, said strip-shaped core being disposed in said endless belt-shaped coating layer and bonded to said coating layer, and said coating layer being made of material having a high frictional resistance coefficient.

34. Holding means according to claim 2, wherein said body of said holding means comprises a strip-shaped core, and an endless belt-shaped coating layer, said strip-shaped core being disposed in said endless belt-shaped coating layer and bonded to said coating layer, and said coating layer being made of material having a high frictional resistance coefficient.

35. Holding means according to claim 3, wherein said body of said holding means comprises a strip-shaped core, and an endless belt-shaped coating layer, said strip-shaped core being disposed in said endless belt-shaped coating layer and bonded to said coating layer, and said coating layer being made of material having a high frictional resistance coefficient.

36. Holding means according to claim 4, wherein said body of said holding means comprises a strip-shaped core, and an endless belt-shaped coating layer, said strip-shaped core being disposed in said endless belt-shaped coating layer and bonded to said coating layer, and said coating layer being made of material having a high frictional resistance coefficient.

37. Holding means according to claim 5, wherein said body of said holding means comprises a strip-shaped core, and an endless belt-shaped coating layer, said strip-shaped core being disposed in said endless belt-shaped coating layer and bonded to said coating layer, and said coating layer being made of material having a high frictional resistance coefficient.

38. Holding means according to claim 6, wherein said body of said holding means comprises a strip-shaped core, and an endless belt-shaped coating layer, said strip-shaped core being disposed in said endless belt-shaped coating layer and bonded to said coating layer, and said coating layer being made of material having a high frictional resistance coefficient.

39. Holding means according to claim 7, wherein said body of said holding means comprises a strip-shaped core, and an endless belt-shaped coating layer, said strip-shaped core being disposed in said endless belt-shaped coating layer and bonded to said coating layer, and said coating layer being made of material having a high frictional resistance coefficient.

40. Holding means according to claim 8, wherein said body of said holding means comprises a strip-shaped core, and an endless belt-shaped coating layer, said strip-shaped core being disposed in said endless belt-shaped coating layer and bonded to said coating layer, and said coating layer being made of material having a high frictional resistance coefficient.

* * * * *